US009812099B1

(12) United States Patent
Nackard

(10) Patent No.: US 9,812,099 B1
(45) Date of Patent: Nov. 7, 2017

(54) NON-FLOATING TREMOLO

(71) Applicant: Kevin Jason Nackard, Flagstaff, AZ (US)

(72) Inventor: Kevin Jason Nackard, Flagstaff, AZ (US)

( * ) Notice: Subject to any disclaimer, the term of this patent is extended or adjusted under 35 U.S.C. 154(b) by 321 days.

(21) Appl. No.: 14/704,839

(22) Filed: May 5, 2015

Related U.S. Application Data

(60) Provisional application No. 61/989,502, filed on May 6, 2014.

(51) Int. Cl.
*G10D 3/14* (2006.01)
*G10D 3/04* (2006.01)

(52) U.S. Cl.
CPC ..... *G10D 3/146* (2013.01); *G10D 3/04* (2013.01)

(58) Field of Classification Search
CPC ..... G10D 3/146
USPC ..... 84/313
See application file for complete search history.

(56) References Cited

U.S. PATENT DOCUMENTS 3,437,001 A * 4/1969 Kraft ..... G10D 3/146 84/312 R
4,632,005 A * 12/1986 Steinberger ..... G10D 3/146 84/297 S
4,656,915 A * 4/1987 Osuga ..... G10D 3/146 84/297 R
5,381,716 A * 1/1995 May ..... G10D 3/146 384/4
5,435,219 A * 7/1995 Huff ..... G10D 3/146 84/313
5,477,765 A * 12/1995 Dietzman ..... G10D 3/146 84/313
5,880,383 A * 3/1999 Huff ..... G10D 3/146 84/313
8,940,986 B1 * 1/2015 Edwards ..... G10D 3/14 84/267
2006/0117930 A1 * 6/2006 Folmar ..... G10D 3/146 84/313
2008/0072735 A1 * 3/2008 Kahler ..... G10D 3/146 84/313
2010/0175534 A1 * 7/2010 McCabe ..... G10D 3/14 84/313

* cited by examiner

*Primary Examiner* — Ruth Ilan
(74) *Attorney, Agent, or Firm* — Invention To Patent Services; Alex Hobson

(57) ABSTRACT

A tremolo bridge mechanism enables pitch adjustment of strings with both ends of the string rigidly attached to the stringed instrument. A pitch adjustment feature incorporates a deflection arm that is coupled with an actuating rod that pivots about a rotational axis as controlled by the tremolo lever. The pitch adjustment features can be configured to enable normal tremolo pitch adjustment or an opposite pitch change for a given motion of the tremolo lever. In a first embodiment, linkages between the actuating rod and deflection arm can be modified to provide variation in the pitch affect. In another embodiment, a spring array can be oriented in two different directions to provide variation in pitch effect for each individual string. In addition, a pitch adjustment feature may be removed, or a string can be routed around the deflection arm, to prevent pitch change with tremolo lever action.

18 Claims, 16 Drawing Sheets

NON-FLOATING TREMOLO

CROSS REFERENCE TO RELATED APPLICATIONS

This application claims the benefit of provisional patent application No. 61/989,502 filed on May 6, 2014 and entitled Non-Floating Guitar Tremolo; the entirety of which is incorporated herein by reference.

BACKGROUND OF THE INVENTION

Field of the Invention

The present invention relates to stringed musical instruments having a bridge that is capable of adjusting string pitch.

Background

Modern electric guitars consist principally of a body, a neck and a peghead. The neck extends from the body to the peghead. Most modern guitar strings have a plain, straight end and a "ball end". The "ball end" is frequently a small metallic cylinder from which the string is wound. Commonly, the plain end of the guitar strings are wound about posts or tuners fixed to the peghead to allow for tuning. The strings run down the neck to body. At the body, the "ball ends" of the strings can be attached to a non-tremolo bridge coupled to the top of the body or the body itself. Non-tremolo type guitar bridges frequently use the ball end of the string to hold the string rigidly to the bridge or pass through the body and are held rigidly into the back of the guitar body. For non-tremolo bridges, the "ball end" of the strings is rigidly fixed in relation to the guitar body.

For tremolo type bridges, the "ball end" of the string is rigidly attached to the bridge plate or cut so that the cut end can be damped rigidly into the bridge. For tremolo type bridges, this bridge plate (or a similar part) is not fixed and can rotate about a pivot point to provide a tremolo effect. The bridge, and hence, the guitar string ends, are not rigidly fixed to the guitar body.

Guitars equipped with a tremolo style bridge allow for changing the pitch of the strings by actuating a tremolo lever extending outward from the bridge, away from the guitar body. Typically, the tremolo lever (commonly known as a tremolo arm or whammy bar) is rigidly fixed to the bridge plate in the plane of the body. The bridge plate is commonly the rigid part of a tremolo bridge to which the saddles and string ends are affixed to. The tremolo lever can be rotated parallel to the bridge plate so that it can be rotated out of the way when not in use. Actuating the tremolo lever towards or away from the guitar body typically rotates the back of the bridge plate into or out of the body about a pivot axis, or fulcrum, at the front of the bridge plate. The pivot axis is perpendicular to the strings when looking at the top of the guitar. This action either stretches or relaxes the strings, thereby increasing or decreasing the pitch of the vibrating strings. Typically, a rigidly attached metallic block extends from the bottom of the bridge plate into a cavity in the body. The cavity in the body is larger than the metallic block and allows for movement of the bridge and block assembly. Two to five tension coil springs are typically fixed to the bottom of this block at one end and the bottom of the guitar body at the other end. The springs are pre-tensioned to pull the block towards the peghead to offset the tension of the strings. String tension can be between 10 to 20 lbf per string, for example. The tension of the springs attached to the bridge block should be adjusted until the bridge plate is relatively parallel to the body when the strings are in tune allowing for an equal range of motion when rotated into or out of the guitar body. These types of tremolos are said to be "floating" because the bridge plate is floating in an equilibrium state between the string and spring tensions against a pivot axis, or fulcrum.

Some players like to rest their hand on the bridge during playing. Additionally, a common technique to diminish the sound of a string is to lightly place the palm on the bridge over the string, commonly referred to as muting. Any force applied to the bridge can disturb the equilibrium of a floating tremolo bridge and cause the guitar to play slightly out of tune. For this reason some tremolo bridges are equipped with various locking mechanisms that, when actuated, can lock the position of the bridge in a neutral position so that the string remains in tune when an external force is applied to the bridge. Some tremolos can lock the position in both directions and some can lock in only one direction, allowing the strings to still decrease in pitch and prevent any change in pitch when a hand is placed on the bridge.

Some characteristics are common to nearly all floating tremolo bridges. actuating the tremolo lever towards the body, when rotated towards the strings, will cause the string pitch to decrease; actuating the tremolo lever away from the body, when rotated towards the string, will cause the pitch to increase; the changes in string length are essentially the same for all the strings of the guitar; all strings are simultaneously affected by actuating the tremolo lever; and the end of the guitar string attached to the bridge rotates with the bridge and is not fixed in relation to the guitar body.

The diameter of the string determines how much the pitch will shift for a given deflection of the tremolo lever. Strings with larger diameter wires, or core wires about which the string is wound will have a larger change in pitch than strings with smaller diameters. For a standard set of electric guitar strings, the low E string can change as much as 5 semitones, while the high E string will shift less than 2 semitones for the same deflection of the tremolo arm. This is due to higher strain in the small diameter strings. For a typical floating tremolo bridge, this means the amount of pitch change for a given deflection of the tremolo lever is not the same for all strings.

Another component that is frequently supplied with a tremolo bridge, specifically Floyd Rose style bridges, is a locking nut. This nut replaces the normal nut at the end of the fingerboard nearest the peghead. The purpose of the locking nut is to eliminate any friction between the nut and string during use of the tremolo. To do this, the string is clamped down so that it cannot move. This prevents the ability to tune the string with the peghead tuners. As a result, many current floating tremolo bridges have "fine tuners" integrated into them to allow for tuning the guitar from the bridge when the string is locked in the nut.

SUMMARY OF THE INVENTION

An exemplary stringed musical instrument of the present invention comprises a bridge having a bridge plate rigidly attached to the body of the guitar and comprises pitch adjustment features that enable adjustment of string pitch through the movement of a tremolo lever while the end of the strings are rigidly attached to the body of the instrument. A bridge plate may be rigidly attached such that it does not move or pivot relative to the body and may comprise a plurality of fasteners configured around the perimeter of the bridge plate, such as proximal to the corners. In an exemplary embodiment, a pitch adjustment feature has components that move relative to the bridge plate, or body, to affect the pitch of a string extending thereover. A plurality of strings may extend down from the peghead. where they are attached to a tuning mechanism, along the neck of the instrument and then through the bridge where they extend over one or more dynamic string contacts, such as a roller or rollers. In an exemplary embodiment, the neck-end of the string is attached to the peghead, or to a tuner on the peghead, and the body-end is attached or secured such that it does not move in relation to the body of the stringed instrument. For example, one or more of the plurality of strings may extend through the bridge and be secured in an aperture that extends from the back surface of the instrument into the bridge cavity. A ball-end of a string may be larger than the aperture and thereby retain the string relative to the body of the instrument. In another embodiment, the ball-end of the body-end of the string is retained by the bottom bracket of the bridge. In this way, the end of the string does not move to adjust the pitch, rather, the dynamic string contact within the bridge, such as a roller, moves to change the tension on the string and therefore the pitch of the string. An exemplary bridge plate is rigidly attached to the body of the instrument and does not move and therefore the pitch adjustment feature moves relative to the bridge plate and the body of the guitar to change the pitch of the string. This unique configuration enables individual adjustment and personalization heretofore not realized.

An exemplary bridge comprises a plurality of pitch adjustment features that are configured to change the pitch of the strings with the movement of a tremolo lever coupled thereto. A tremolo lever may be coupled with an actuating rod which is coupled with a deflection arm. A string may extend over the deflection arm and the deflection arm may pivot or otherwise move in response to the tremolo movement to change the tension and pitch of a string. One or more rollers may be coupled with the deflection arm and a string may extend over the roller to enable the string to be deflected by the deflection arm without excessive friction.

A spring may be configured to exert a force on a deflection arm to return the deflection arm to an original position, or neutral position, as determined by the string tension, after a tremolo lever has been used to move the deflection arm. A neutral position of a pitch adjustment feature is a position wherein the string tension brings the pitch adjustment feature to a position not affected by a force exerted by a tremolo lever. A pitch adjustment feature may comprise an actuating rod that is coupled to the deflection arm by a linkage. The linkage may have two or more pin locations on either the actuating rod or the deflection arm to allow variations in coupling positions between the actuating rod and the deflection rod. In one embodiment, a linkage may be pinned in a first pin location on the actuating rod and to a pin on the deflecting arm to cause an increase in pitch when the tremolo lever is moved in a first direction. When the linkage is pinned in a second pin location on the actuating rod, the same motion of the tremolo lever may cause a decrease in pitch, thereby reversing the effect. The two pins on the actuating rod may be offset by a distance that creates this reversible effect, or they may be configured on either side of a plane extending through the rotation axis of the actuating rod. An actuating rod may rotate about an axis and the first pin location may be on one side of a plane extending through the rotation axis and the second pin location may be on the other, or opposing side of said plane. A first pin location may move toward the deflection arm while the second pin location may move away from the deflection arm with movement of the tremolo lever. This reversible pitch adjustment feature enables a user to personalize the bridge with some pitch adjustment features having an increase in pitch and some having a decrease in pitch for the same movement of the tremolo lever.

In one embodiment, a pitch adjustment feature or a portion thereof may be detached from the bridge. A user may want only some of the strings to be affected by the movement of the tremolo lever and remove the deflection arms, for example, as desired to create their own personalized bridge set-up. A string extending through the bridge with a pitch adjustment feature, or portion thereof, removed may still have one or more string contacts that enable the string to be kept under a desired tension and in some cases tuned by adjustment of a position of string contact, such as a roller.

One or more of the string contacts, such as rollers, may be adjustable in position, wherein the string contact can be moved from a first position to a second position and thereby change the tension in a string extending thereover. In an exemplary embodiment, a roller, such as a base roller as described herein, is configured to move in a direction that is substantially parallel with the plane of the bridge plate, or generally along the length axis of a string extending thereover and is capable of increasing or decreasing the amount of pitch change for a given amount of rotation of a tremolo lever about a rotational axis of an actuating rod, as described herein. Therefore, an exemplary bridge mechanism of the present invention enables complete customization with respect to the effect movement of the tremolo lever has on each string. A user may decide which strings they want affected by the tremolo lever and then adjust the amount of pitch change and type of pitch change.

A tremolo lever has an attached end that may be directly coupled to an actuating rod. A tremolo lever is configured to rotate about a rotational axis of an actuating rod that is part of a pitch adjustment feature, or put another way, generally toward or away from the instrument body. A tremolo lever may also be configured to swivel, wherein the extended end of the tremolo lever may swing or rotate in a direction generally parallel with the instrument body, or bridge plate. A tremolo lever may have a neutral position that does not affect a set pitch of the strings, or wherein the tremolo lever is not moving an actuating arm and/or deflection lever to move a string contact and change the pitch of a string. In an exemplary embodiment, a tremolo lock is provided to retain the tremolo lever in a desired position, such as a neutral position or some offset position from neutral wherein the pitch of some of the strings may be affected. A ramp may have an inclined plane that interfaces with a lever lock and friction between the incline plane of the ramp and the lever lock may be sufficient to hold and retain the tremolo lever in any desired position. A lever lock may be configured to be adjustably positioned along the length of the tremolo lever and also configured to rotate about the tremolo lever, thereby providing two degrees of adjustability of the lever lock. For example, a tremolo lever may be swiveled into contact with the ramp and the lever lock may be moved to change the orientation of the tremolo lever when the lever lock and ramp intersect with each other. The infinitely adjustable tremolo lock enables a user to set the lever lock in a position such that the tremolo lock can be retained on the ramp in a neutral position and can then be slid up or down the ramp to adjust the pitch of the strings. In this way, a change in pitch may be held without the need to hold onto the tremolo lever.

In an exemplary embodiment, a stringed musical instrument comprises a string tuner extension that extends from an instrument string to a tuner and comprises a material that has much less elongation under tension than the instrument string, thereby significantly reducing movement and friction of the instrument string over a nut located proximal to the end of the neck. An exemplary string tuner extension comprises a string lock that is configured to attach to a string, such as proximal to the neck end of the string, and a tuner extension that extends from the string lock to a tuner. A tuner extension preferably has much less elongation than the instrument string for the same tensile load and therefore reduces the amount of motion and friction of the instrument string over the nut. A tuner extension may have about one-half, about one-quarter, about one-tenth or even about one-one hundredth or less the elongation of the instrument string for a given tensile load. A string lock is free floating and therefore allows tuning of the string through conventional means, such as by turning the tuner on the peghead. The string lock may comprise a slot for receiving the instrument string and a fastening device, such as a screw, that can be tightened to secure the instrument string to the string lock. The tuner extension is configured to extend from the sting lock to a tuner on the peghead and couple with the tuner as would a conventional instrument string. The string lock may be configured proximal to the nut configured proximal to the extended end of the neck of the instrument and between the nut and the tuner.

An exemplary embodiment of the present invention solves many of the inherent problems associated with a floating tremolo. Additionally, it offers several features that are not available in other tremolo bridges including floating or non-floating bridges. An exemplary embodiment of the present invention provides a non-floating tremolo bridge, in that the bridge plate is rigidly attached to the body and both ends of the strings are fixed in relation to the body of the guitar during tremolo use. A mechanism configured under the bridge plate manipulates the string via a tremolo lever(s) extending through the bridge plate. Mounted in the bridge plate is a series of rollers (at least one for each string). The position of each roller can be adjusted forward, towards the peghead, or backwards, away from the peghead. Mounted to the top of the bridge plate is a series of adjustable saddles. Each saddle has a roller to minimize friction and can be adjusted for achieving proper string intonation, lateral positioning, and correct string height. The mechanism attached to the bottom of the bridge plate consists of an actuating rod connected by two ball bearings housed in a pillow block at each end rigidly attached to the bridge plate. At the base of the pillow blocks, a bottom bracket is rigidly attached in which a series of removable deflection arms are attached. Each deflection arm comprises a roller which the string passes over to minimize friction. The deflection arms can rotate about one end via a pin in the bottom bracket and are in contact with a compression spring at the other end. The compression spring counters the force exerted by the string tension. The end of the spring not contacting the deflection arm interacts with a spring bracket that can be adjusted to allow for assembly and spring tension adjustment. The actuating rod is connected to each deflection arm via a linkage that is pinned at both the actuating rod and the deflection arm. There are two possibilities for pinning the linkage to the actuating rod. Which one is chosen will determine if the string increases or decreases pitch for a given deflection of the tremolo lever. An exemplary pitch adjustment feature comprises a deflection arm, dynamic string contact and spring which act in tandem with the actuating rod and tremolo lever to change the pitch of the string and return the string back to a neutral position after the tremolo lever is returned to a neutral position. As described above, this is one exemplary embodiment of the present invention.

To string an instrument, such as a guitar, having the exemplary bridge described, the straight end of the string is first fed through a hole in the back of the body of the guitar. The string then passes through a hole on the bottom bracket and into a channel on the deflection arm. The string then passes over the roller in the deflection arm where it then passes through the bridge plate. The string passes over the roller in the bridge plate and then over the saddle roller. The string is then pulled until the "ball end" of the string is seated in the hole on the back of the guitar body and the straight end of the string is attached to a tuner mounted to the peghead.

In an exemplary embodiment, there are a series of rollers that each string will pass over. The total length change of the string during typical tremolo use is roughly between 0.5 to 1.5 mm. This very slight movement can be greatly affected by any friction in the mechanism and this friction may prevent the string from returning to the correct pitch. Because of this, it is desirable to use ball bearings for rollers and for movements in the mechanism, when possible. It is only by reducing friction as much as possible that the string will return to the correct pitch after using the tremolo lever.

In an exemplary embodiment, a pitch adjustment feature may be configured in one of three ways. First, the linkage pinned to the deflection arm can be attached to the actuating rod such that the tremolo lever affects the string the same as a normal floating tremolo, i.e., rotating the tremolo lever towards the guitar body decreases the string pitch. Second, the linkage can be attached to the actuating rod so that the tremolo lever affects the string in an opposite way to that of a normal floating tremolo. i.e., rotating the tremolo lever towards the guitar body increases the string pitch. Third, the deflection arm, spring and linkage can be removed so that the string pitch is not affected by actuating the tremolo lever. By configuring each string individually, it is possible to have some or all strings increase pitch, and some or all strings decrease pitch simultaneously. This makes it possible for some strings to increase pitch, some strings to decrease pitch and some strings to remain at the same pitch for a single motion of the tremolo lever. This enables the player to make a sound that has heretofore has not been possible from a stringed instrument, such as a guitar. Again, this unique configuration enables individual adjustment and personalization heretofore not realized.

The amount a string will change in pitch for a given amount of tremolo lever motion can also be adjusted via the movable rollers on the bridge plate, herein referred to as base rollers. There is one base roller per string and it's position can be adjusted with a screw in the bridge plate towards or away from the peghead. The position of the base roller axially to the string determines how much the string stretches or relaxes for a given movement of the tremolo lever. By adjusting the position of the base roller it is possible to change the amount of pitch change for each string. Because a larger deflection is required to achieve the same pitch shift for smaller diameter strings, the base rollers for the higher strings can be positioned farther towards the peghead. This allows for tuning the strings so that the amount of pitch change is the same for all, or some of the strings.

Additionally, a tremolo lock may be configured on the stringed instrument, such as attached to the bridge to enable the tremolo lever to be locked in a non-neutral position. The combination of having the ability to change if a string decreases or increases in pitch upon lever actuation or not at all, adjusting the amount the pitch changes individually for each string, and being able to lock the actuating rod in a non-neutral position, allows for the unique possibility to change to an alternate tuning by simply rotating the tremolo lever to a pre-determined position. The present invention provides a lock that holds the tremolo lever in a pre-set, non-neutral location.

Another common problem associated with tremolo levers is that there is frequently slop between the tremolo lever and the bridge motion due to a tremolo lever being threaded loosely into the bridge plate so that it is still able to rotate. In an exemplary embodiment of the present invention, this problem is solved by using a tremolo lever connector that is firmly attached to the actuating rod. The tremolo lever threads directly into the actuating rod and a tapered section interacts with the tremolo lever connector to minimize any slop and provide a better translation of the force on the tremolo lever to the actuating rod.

Finally, an ancillary component is supplied that prevents the need for a locking nut. During use of the tremolo bar to increase the pitch of the string, the amount of strain in the string is greatest at the bridge saddle and zero at the peghead tuner. Because of this, the amount of string motion at the nut that can contribute to friction is a function of the length of the string between the nut and the peghead tuner. This friction at the nut can be greatly reduced by using a string tuner extension that clamps the string very near to the nut and has a very strong cable or string that extends to the peghead tuner. This will allow for use of the peghead tuners to tune the instrument without the need for a locking nut.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1A:
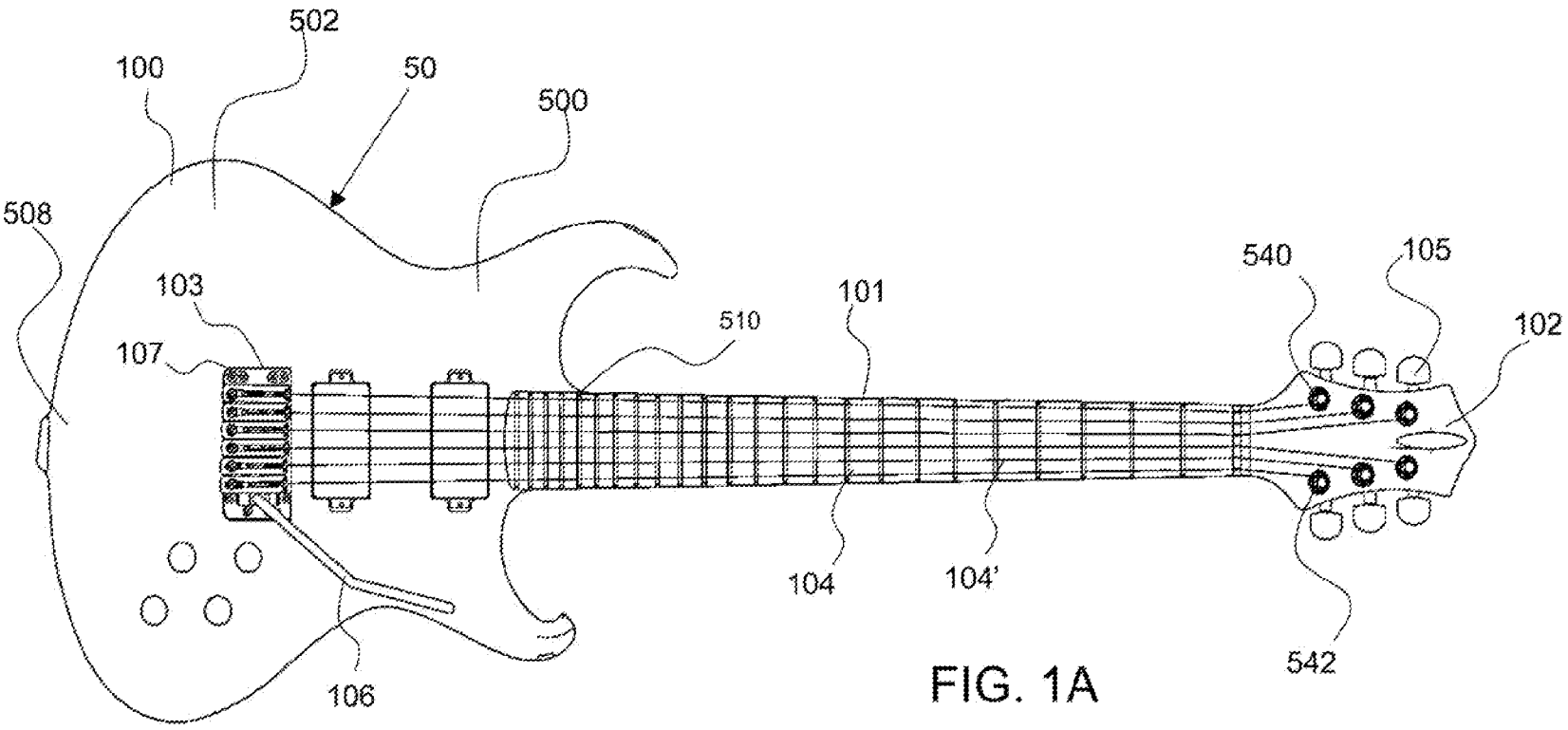
FIG. 1A is a front view of a guitar incorporating an exemplary bridge as described herein.

The summary of the invention is provided as a general introduction to some of the embodiments of the invention, and is not intended to be limiting. Additional example embodiments including variations and alternative configurations of the invention are provided herein.

DETAILED DESCRIPTION OF THE ILLUSTRATED EMBODIMENTS

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale and some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for the purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1A, an exemplary electric guitar, an example of a stringed instrument 50, comprises a body 100 with a neck 101 extending from it to a peghead 102. The body of the stringed instrument has a front surface 502, a back surface and a bridge cavity configured to receive the tremolo bridge mechanism 103. Instrument strings, i.e., 104, 104', are attached at one end to the back of body 100 and extend through the tremolo bridge mechanism 103 and across the guitar neck 101 where they are attached to tuning mechanisms 105, or tuners. The tremolo bridge mechanism 103 is rigidly mounted to the body 100 and the string pitch is manipulated by actuating the tremolo lever 106. The bridge is rigidly attached to the guitar body and does not move relative to the body. The bridge plate 107 is attached to the front surface 502 in a plurality of locations around the perimeter of the bridge plate, such as in the corners with fasteners. The body has a base end 508 and a neck end 510. The neck 101 extends from the body to an extended end 542, or the peghead 102. A plurality of tuners 105 are configured on the peghead. The strings 104, extend to string attachments 540 coupled to the tuner.

Figure 1B:
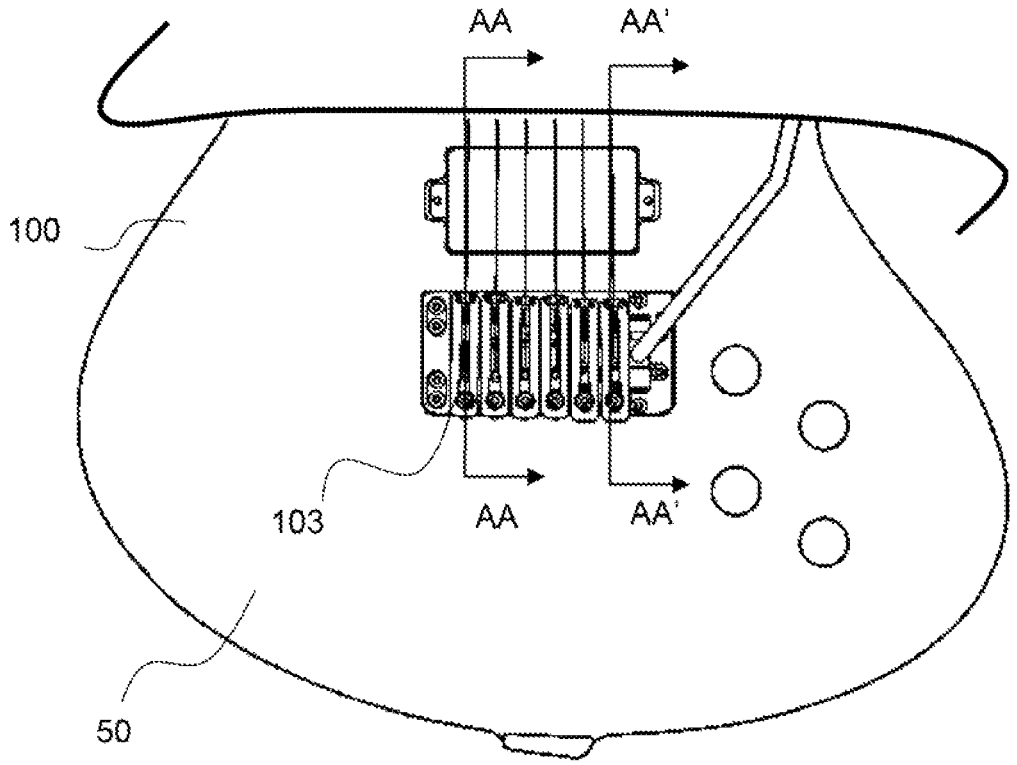
FIG. 1B is an enlarged front view of a portion of the guitar shown in FIG. 1A.

As shown in FIG. 1B, the exemplary bridge 103 is secured into the body 100 of the stringed instrument 50. Cross section views of the bridge mechanism 103 along lines AA and AA' are provided in FIGS. 12-17 showing a reversible pitch adjustment feature.

Figure 2:
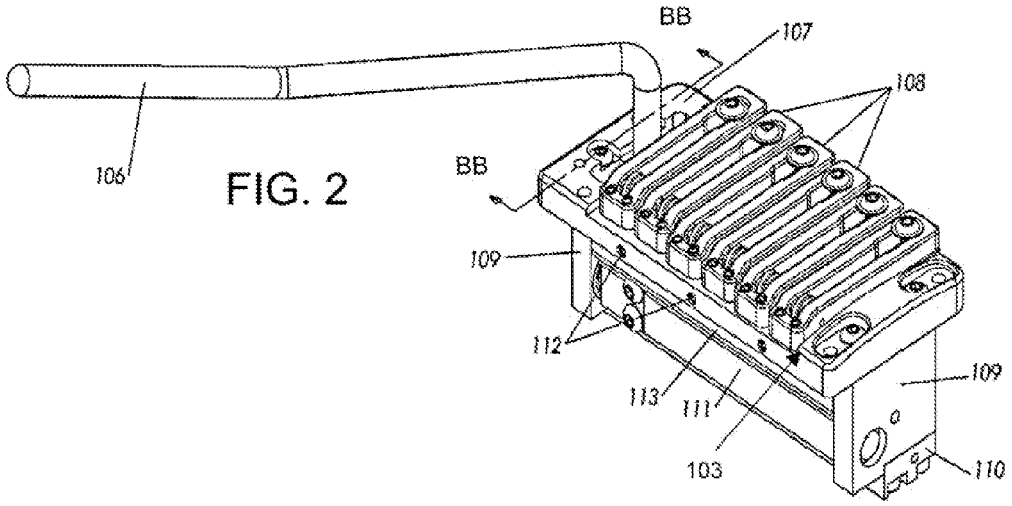
FIG. 2 is a front perspective view of an exemplary bridge as described herein.
Figure 3:
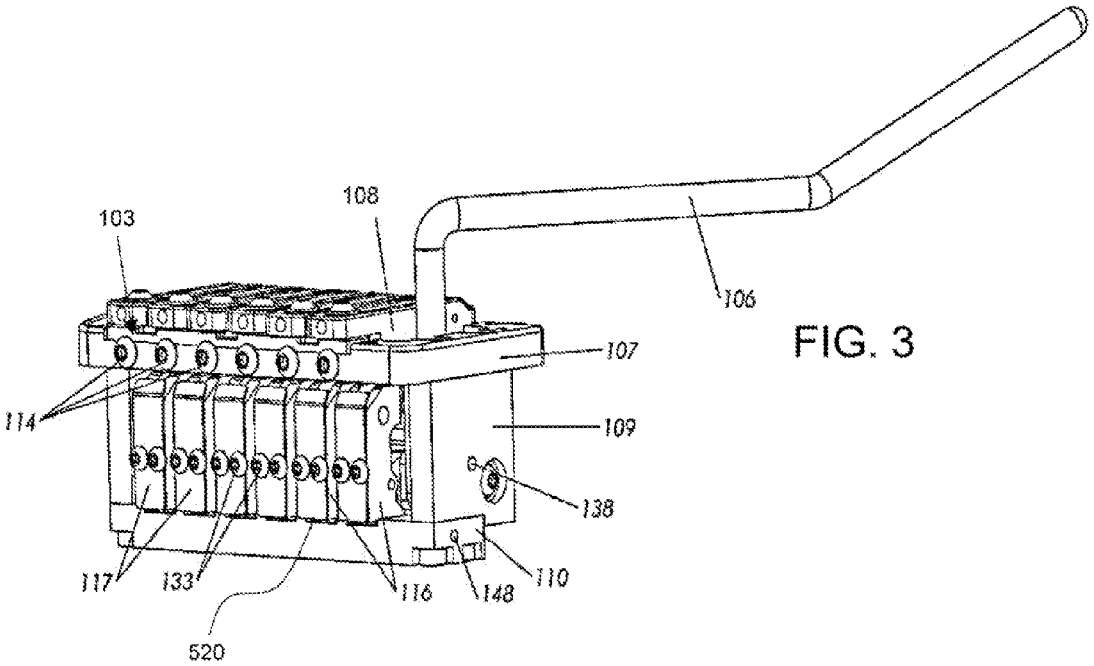
FIG. 3 is a back perspective view of an exemplary bridge as described herein.

FIG. 2 and FIG. 3 are front and back perspective illustrations of an exemplary tremolo bridge mechanism 103, respectively. The exemplary tremolo bridge mechanism consists of a bridge plate 107 to which bridge saddle assemblies 108 are adjustably attached. The pillow blocks 109 are rigidly attached to the bridge plate 107. The bottom bracket 110 is rigidly attached to the pillow blocks 109. An actuating rod 111 is rotatably attached to the pillow blocks 109. The tremolo lever 106 is attached to an actuating rod 111. Screws 112 are used to adjust the position of spring bracket 113. Screws 114 are used to adjust the position of the base rollers 115, shown in FIG. 11. Assembled deflection arms 116 are pinned by a pin 148 to the bottom bracket 110. A string guide 117 is attached to each deflection arm 116 to aid passing the string through the bridge 103. The bridge 103 comprises a plurality of discrete pitch adjustment features 520 that are configured to change the pitch of strings with movement of the tremolo lever.

Figure 4:
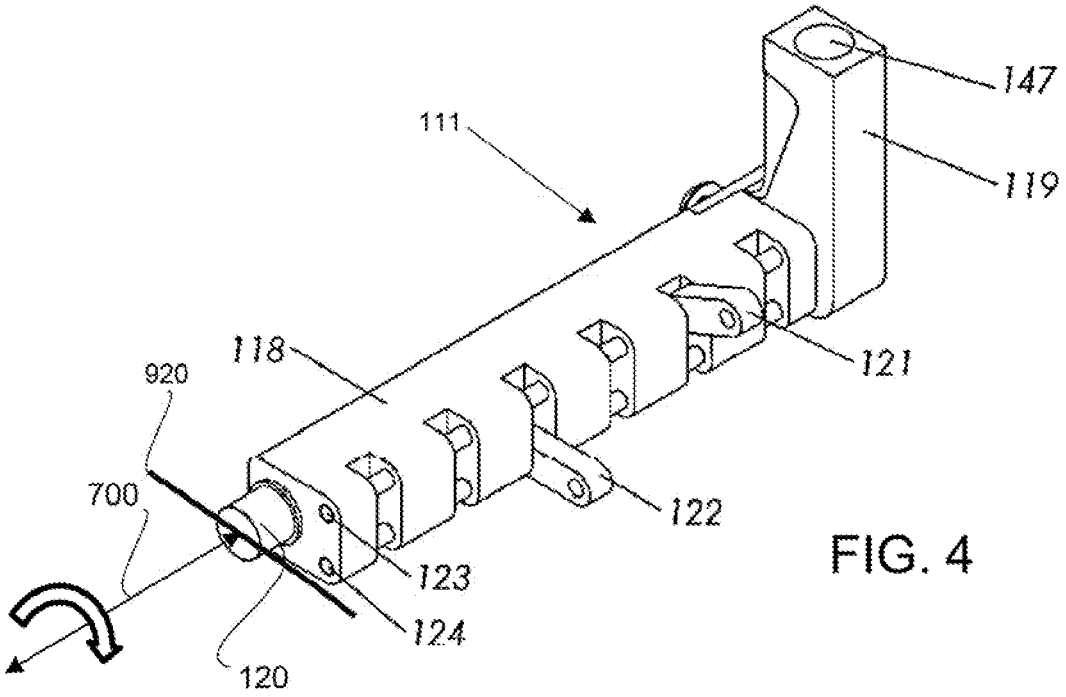
FIG. 4 is a front perspective view of an exemplary actuating rod having two pin locations as described herein.
Figure 5:
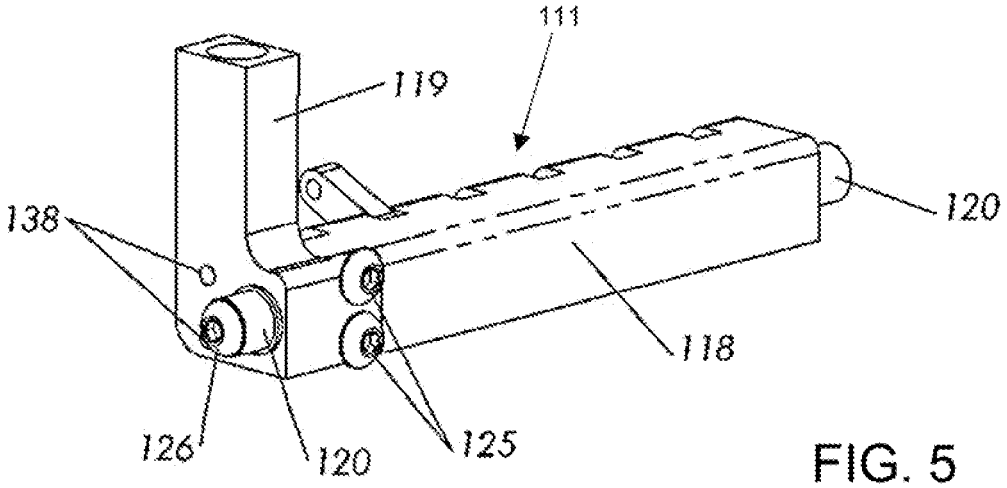
FIG. 5 is a back perspective view of an exemplary actuating rod as described herein.
Figure 9:
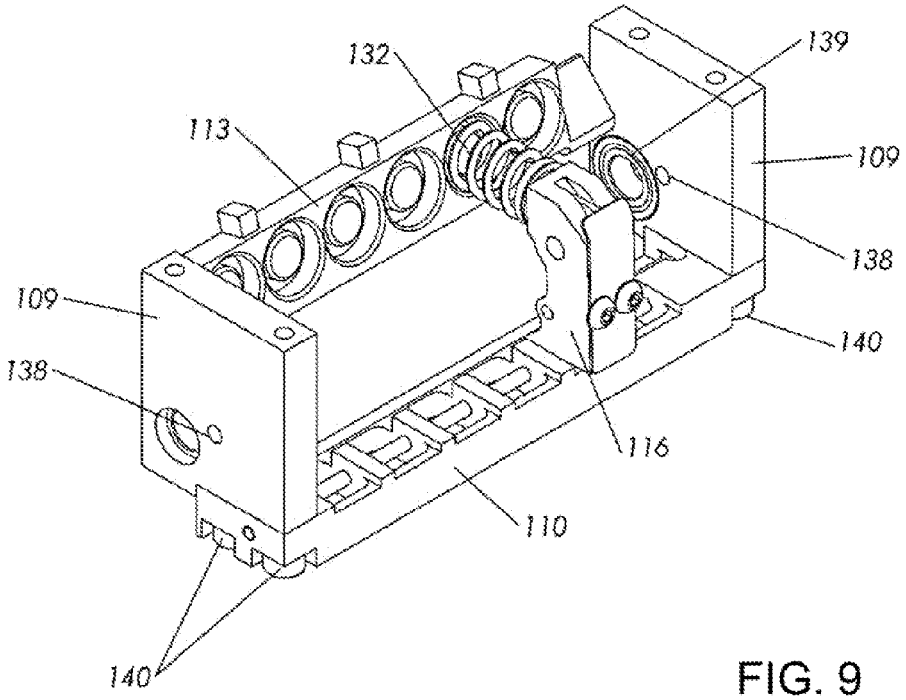
FIG. 9 is a perspective view of a partial assembly of an exemplary bridge having a bottom bracket with a deflection arm, two pillow blocks, spring, and spring bracket.

FIG. 4 and FIG. 5 show details of an exemplary actuating rod 111. The exemplary actuating rod 111 comprises a tremolo connector portion 119 and a rotational portion 118. The tremolo lever (not shown) is attached to the tremolo connector portion 119 and is configured for insertion into an aperture 147. A cylinder 120 seats into bearings 139 in the pillow blocks 109 when assembled, as shown in FIG. 9. The rotational portion 118 rotates about a rotational axis 700 that extends along the length of the actuating rod, as indicated by the bold arrow. When the tremolo lever is rotated about the rotational axis, the actuating rod 111 rotates. Each linkage 121 is pinned by a pin 123 such that the deflection arm (not shown) will move similar to a standard tremolo (i.e. rotating the tremolo lever towards the body will cause the string pitch to decrease). Each linkage 122 is pinned by a pin 124 such that the deflection arm will behave opposite that of a standard tremolo. The first pin 123 is on one side of a plane extending through the rotational axis, above the rotational axis, and the second pin 124 is on an opposing side, or below said plane. Screws 125 and 126 rigidly connect the rotational portion 118 and connector portion 119 together.

Figure 6:
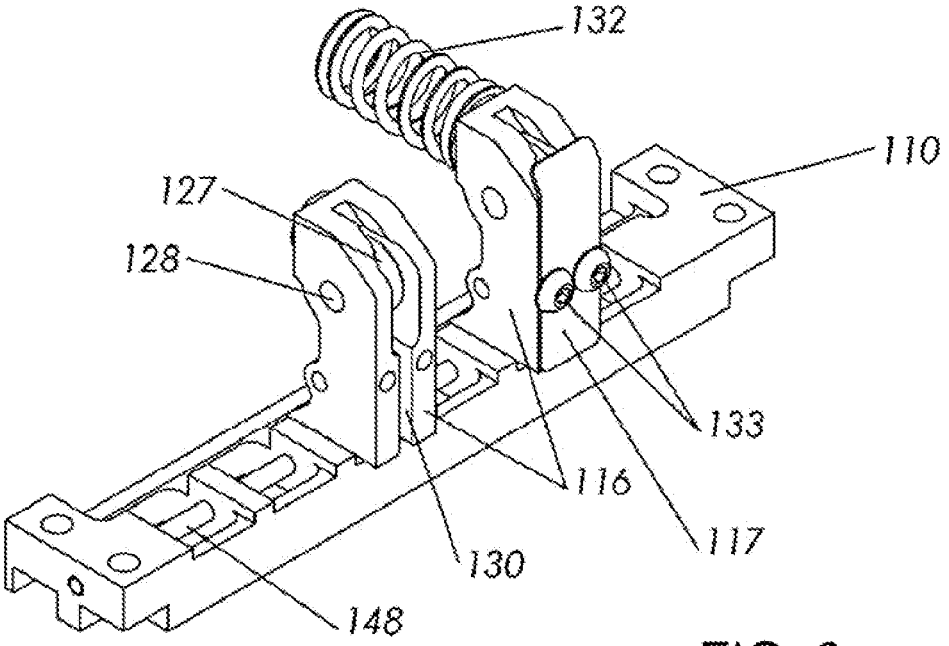
FIG. 6 is a perspective view of a partial assembly of an exemplary bridge having a bottom bracket with two deflection arms and a spring.
Figure 7:
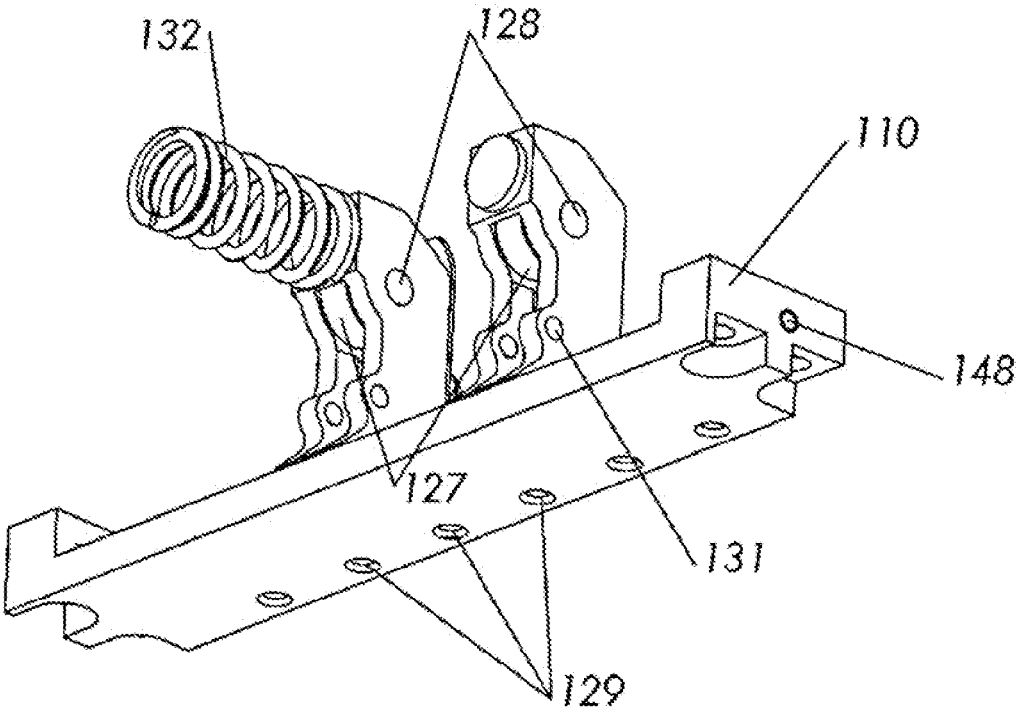
FIG. 7 is a bottom perspective view of a partial assembly of an exemplary bridge having a bottom bracket with two deflection arms and a spring.

FIG. 6 and FIG. 7 show details of exemplary deflection arms 116 coupled to a bottom bracket 110. Each deflection arm 116 has a roller 127 that is pinned by a pin 128 allowing rotation of the roller with respect to the deflection arm. Each deflection arm 116 is pinned by a pin 148 to the bottom bracket 110, thereby allowing rotation about the pin 148 of the deflection arm with respect to the bottom bracket. An instrument string is configured to pass through holes 129 in the bottom bracket 110 and into channel 130 where it then passes over a roller 127. Holes 131 are pin locations for coupling a linkage (121 and 122 as shown in FIGS. 4 and 5), between the actuating rod and the deflection arms 116. Compression spring 132 is seated to the deflection arm 116 to oppose string tension. A string guide 117 is fixed by screws 133 to the deflection arm 116 and is configured to guide the string through bridge plate (107 shown in FIG. 2).

Figure 8:
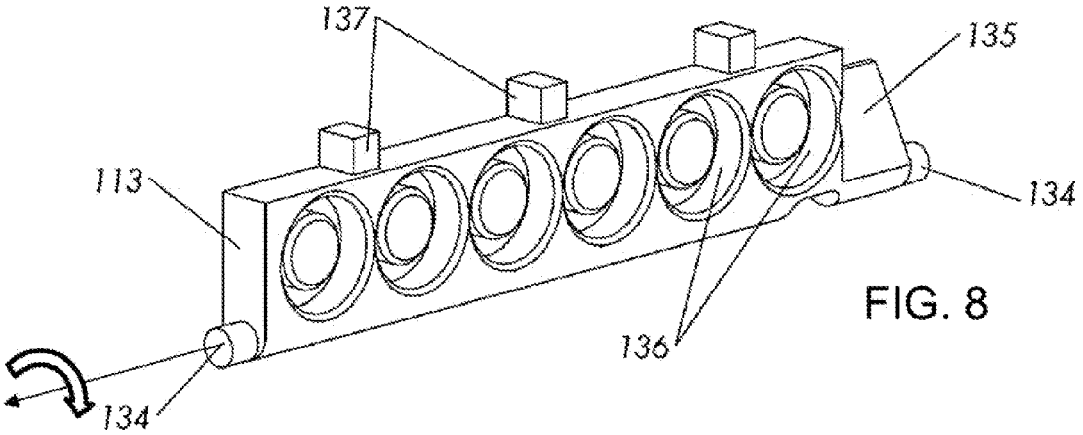
FIG. 8 is a perspective view of an exemplary spring bracket.

FIG. 8 is a perspective Illustration of spring bracket 113 and FIG. 9 is an illustration showing how the spring bracket 113 is assembled. Cylinders 134 seat into holes in the pillow blocks (not shown) and allow the spring clamp 113 to rotate about an axis of rotation that extends from the cylinders. This rotation makes assembling the device easier and allows for some tension adjustment of springs 132. A ramp 135 allows for a greater range of motion of the actuating rod during use. Springs 132 are configured into recesses 136 in the spring bracket 113 when assembled. Teeth 137 are recessed into the bridge plate and are used to rotate the spring bracket 113 via set screws (112 shown in FIG. 2). Holes 138 are used to remove pins (123 or 124 as shown in FIG. 4) without completely dis-assembling the mechanism. Screws 140 are used to rigidly attach the pillow blocks 109 to the bottom bracket 110.

Figure 10:
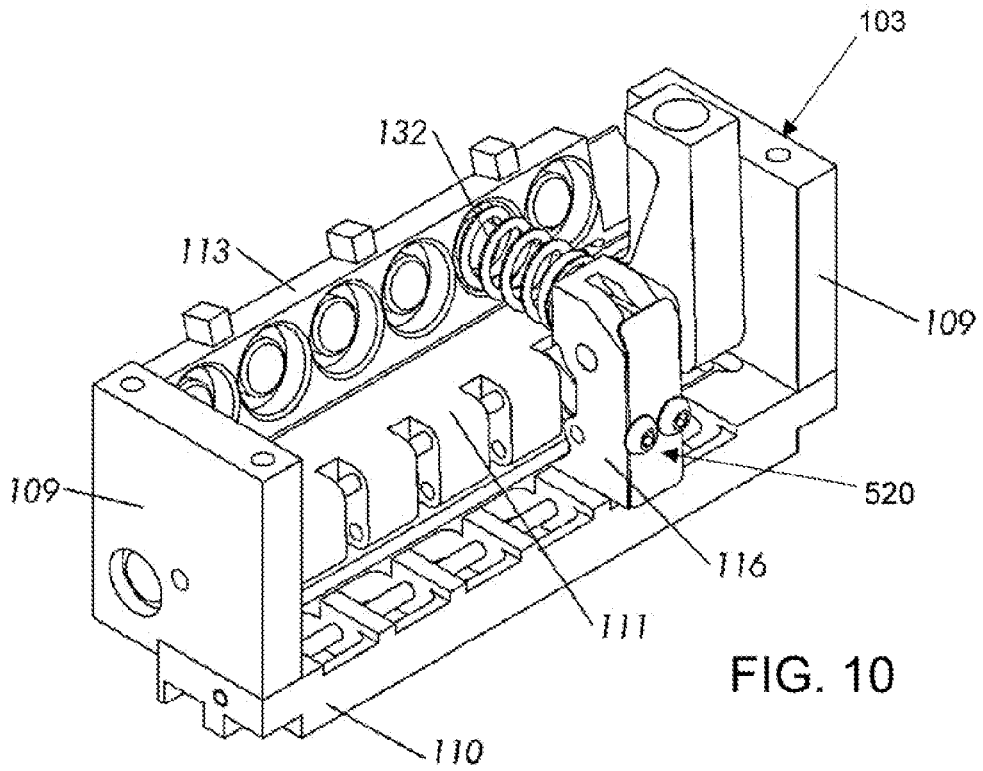
FIG. 10 is a perspective view of a portion of an exemplary bridge having a bottom bracket with a deflection arm, two pillow blocks, spring, spring bracket, and actuating rod coupled together.

As shown in FIG. 10, an exemplary tremolo bridge mechanism 103 comprises an actuating rod 111 and a single deflection arm 116. The deflection arm is configured to be detachably attachable, and therefore can be removed when no pitch adjustment is desired with movement of the tremolo lever for a particular string.

Figure 11:
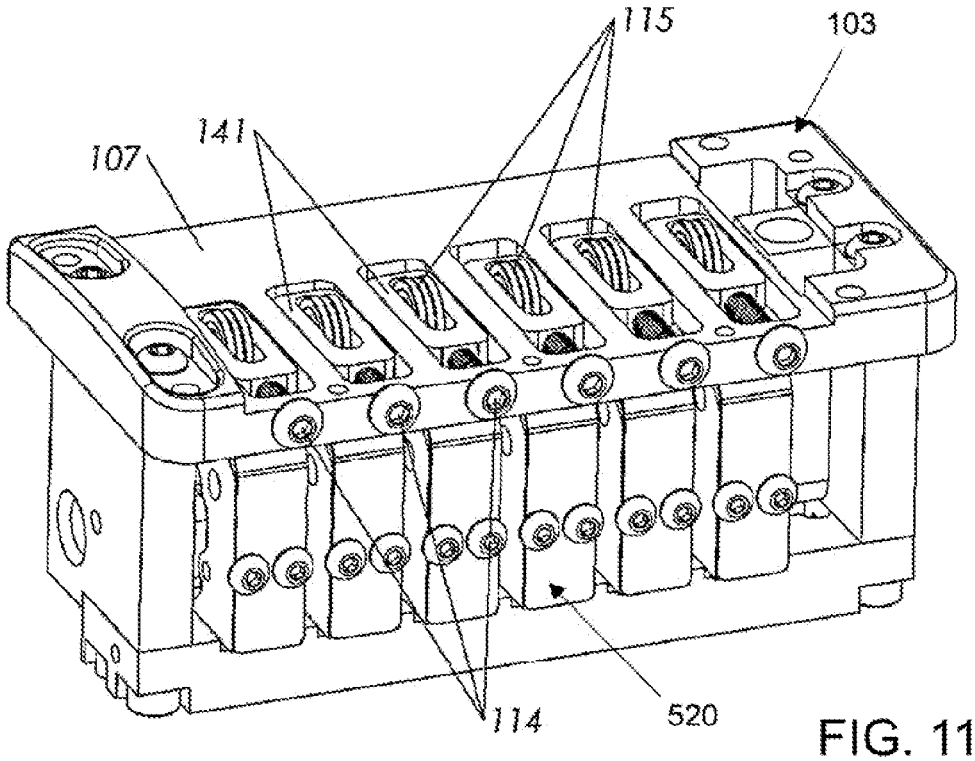
FIG. 11 is rear perspective view of an exemplary bridge without the bridge saddles.

As shown in FIG. 11, an exemplary bridge 103 comprises six discrete pitch adjustment features 520. The bridge is shown with the saddles removed. Rollers 115 are pinned to carriers 141 and slide in bridge plate (107 as show in FIG. 2). The position of the rollers 115 can be adjusted via screws 114. The rollers 115 are adjustable rollers and can be moved in a direction that is substantially parallel with the plane strings. As shown in FIGS. 10 and 11, an exemplary pitch adjustment feature 520 comprises components within the bridge that are configured to adjust string tension as a function of movement of a tremolo lever. An exemplary pitch adjustment feature comprises a deflection arm having at least one dynamic string contact and a spring 132.

Figure 12:
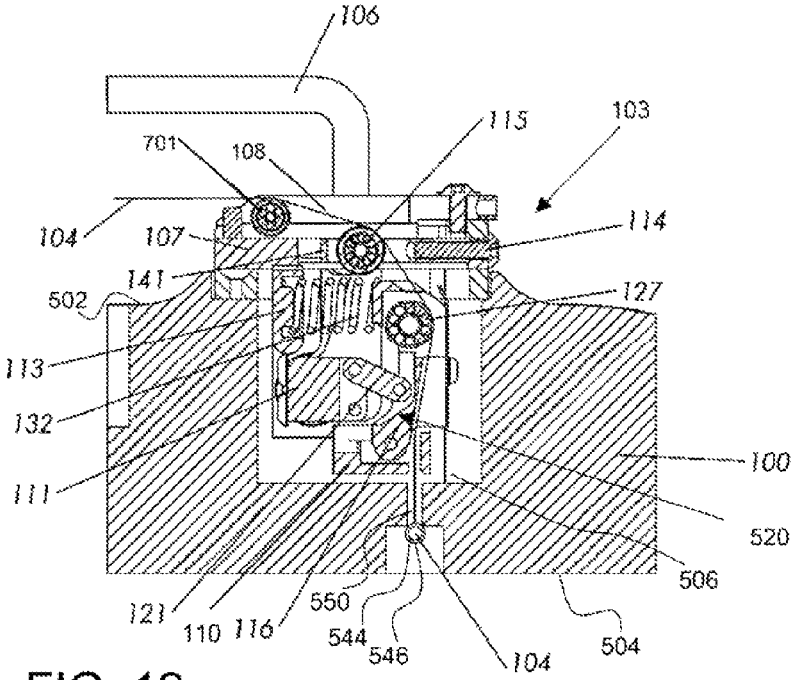
FIGS. 12-14 are section views of an exemplary bridge configured in a bridge cavity of the stringed instrument taken across line AA-AA of FIG. 1B, with the linkage in a first pin location on the actuating rod.
Figure 13:
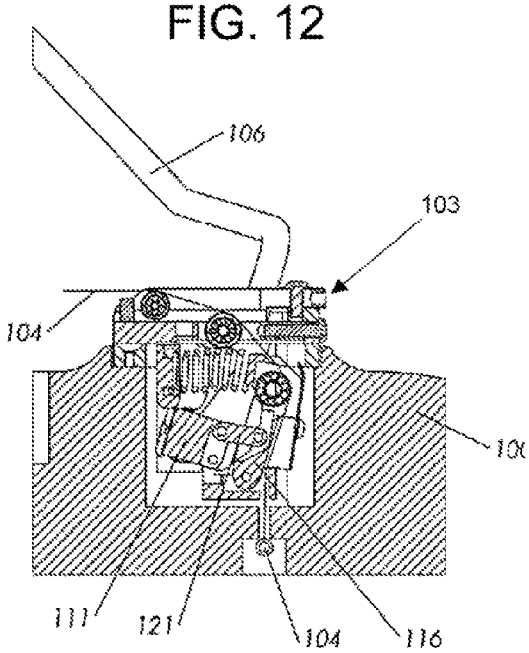
Figure 14:
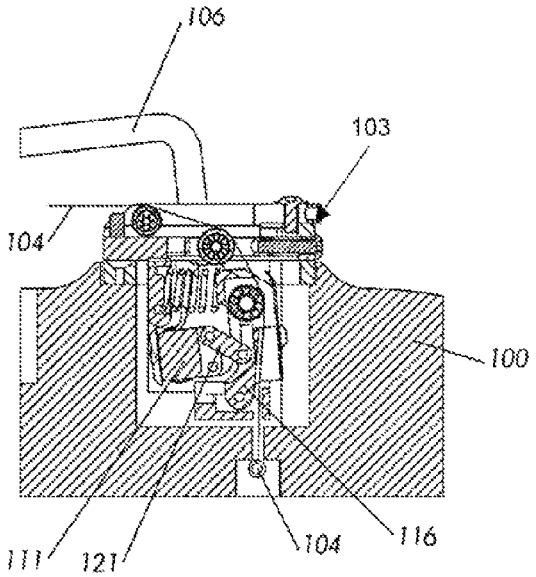

Referring to FIGS. 12-14, section views of the pitch adjustment feature 520 demonstrate how movement of the tremolo lever changes the pitch of a string. FIG. 12 shows the exemplary tremolo bridge mechanism 103 in the neutral position, with no force applied to the tremolo lever 106. A string 104, is rigidly attached to the guitar body 100. The body-end 544 of the string comprises a ball-end 546 that is retained in an aperture 550 that extends from the back surface 504 of the instrument body 100 to the bridge cavity 506. The string then passes through the bottom bracket 110 and over a deflection arm roller 127, through bridge plate 107 and over a base roller 115, then over the saddle roller 701 in the saddle assembly 108. The position of the base roller 115 is adjustable in the bridge plate 107 via screw 114 towards or away from the peghead by means of carrier 141. The position of the base roller 115 influences the amount of pitch change for a given amount of tremolo lever actuation. Spring 132, counteracts the force on the deflection arm 116 created by the string tension. Linkage 121 is connected to the actuating rod 111 in the first pin location (123 as shown in FIG. 4) such that the tremolo will function in the same manner as a traditional tremolo. The string will decrease in pitch when tremolo lever is actuated towards guitar body.

Referring to FIG. 13, the tremolo lever 106 has been actuated by a user away from the guitar body 100. This illustration shows how the deflection arm 116 functions in this scenario. When tremolo lever 106 is actuated, the deflection arm 116 moves such that the tension in string 104 is increased, resulting in an increased string pitch. When force is removed from the tremolo lever 106, the string tension will return the deflection arm 116 to the neutral position as shown in FIG. 12.

Referring to FIG. 14, the tremolo lever 106 has been actuated by a user towards guitar body 100. This illustration shows how the deflection arm 116 functions in this scenario. When tremolo lever 106 is actuated, the deflection arm 116 moves such that the tension in string 104 is decreased, resulting in a decreased string pitch. When force is removed from the tremolo lever 106, the string tension will return the deflection arm 116 to the neutral position as shown in FIG. 12. FIGS. 13 and 14 shown how the actuating rod rotates about a rotation axis as shown in FIG. 4.

Figure 15:
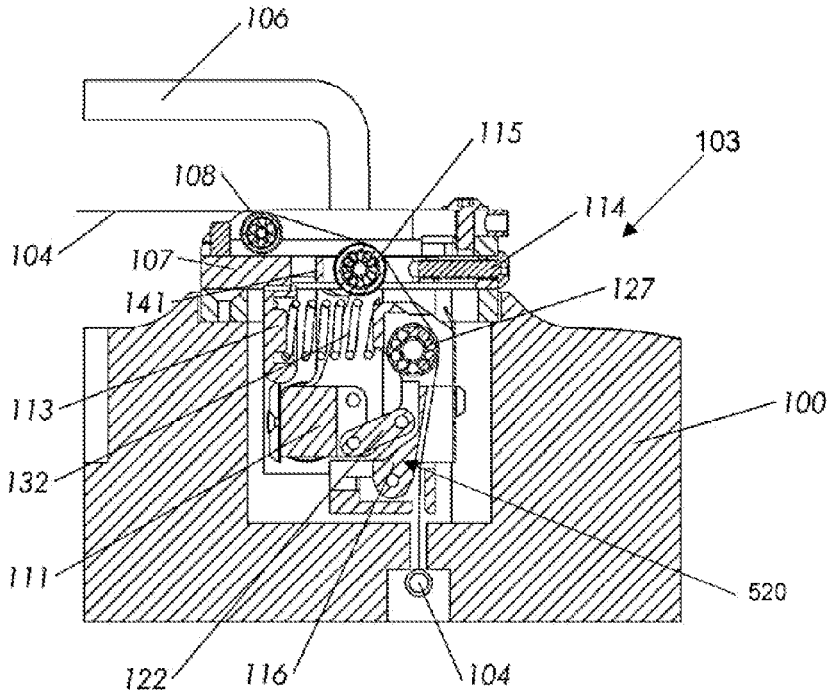
FIGS. 15-17 are section views of an exemplary bridge configured in a bridge cavity of the stringed instrument taken across line AA'-AA' of FIG. 1B; with the linkage configured in a second pin location of the actuating rod. These figures show the invention with the tremolo lever in the neutral position, actuated away from the guitar body, and actuated towards the guitar body, respectively.
Figure 16:
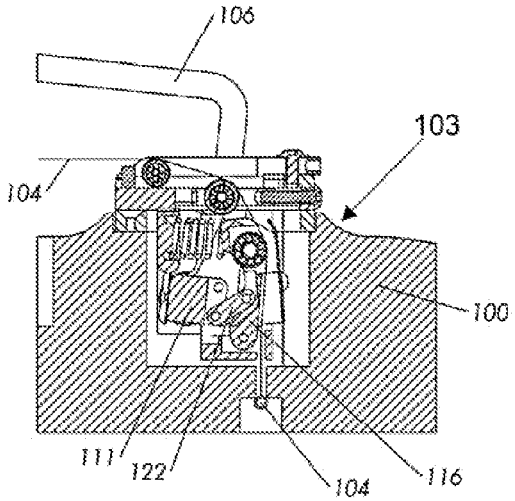
Figure 17:
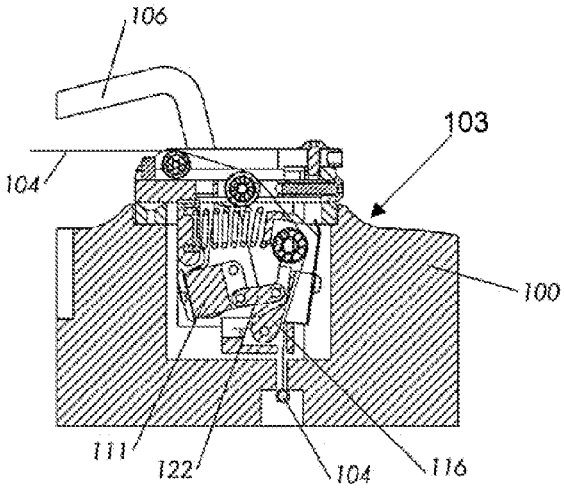

Referring now to FIGS. 15-17, section views of the pitch adjustment feature 520 demonstrate how movement of the tremolo lever changes the pitch of a string with the linkage in the second pin location, as shown in FIG. 4. FIG. 15 shows the exemplary tremolo bridge mechanism 103 in the neutral position, with no force applied to the tremolo lever 106. FIG. 15 is the same as FIG. 12, except the linkage 122 is now connected to the actuating rod 111 by pin (124 as shown in FIG. 4), such that the tremolo will function opposite a traditional floating tremolo, wherein strings will increase in pitch when tremolo lever is actuated towards guitar body.

As shown in FIG. 16, when the tremolo lever 106 is actuated away from the guitar body 100, the deflection arm 116 moves such that the tension in string 104 is decreased, resulting in a decrease in string pitch. When the force is removed from the tremolo lever 106, the string tension will return the deflection arm 116 to the neutral position as shown in FIG. 15.

As shown in FIG. 17, when the tremolo lever 106 is actuated towards the guitar body 100, the deflection arm 116 moves such that the tension in string 104 is increased, resulting in an increase in string pitch. When force is removed from tremolo lever 106, the string tension will return the deflection arm 116 to the neutral position as shown in FIG. 15.

FIGS. 12-17 demonstrate how a pitch adjustment feature can be reversible by changing the pin location of the linkage to the actuating rod. It is to be understood that each individual linkage of a pitch adjustment feature can be configured as desired in the actuating rod, thereby providing complete customization of the effect of the tremolo motion on the pitch of the strings.

Figure 18:
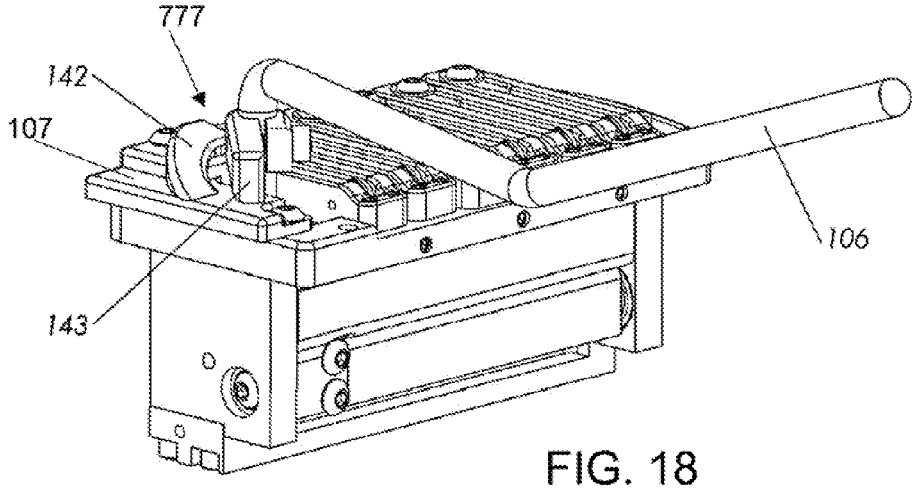
FIG. 18 is a perspective view of an exemplary bridge with the tremolo lever in the neutral position and the arm-lock attached but not engaged.
Figure 19:
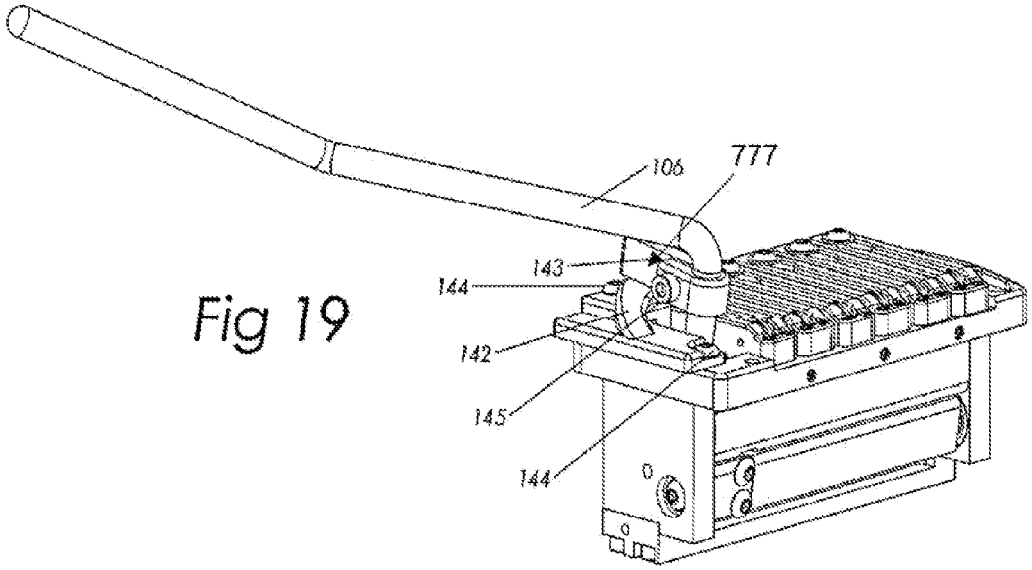
FIG. 19 is a perspective view of an exemplary bridge with the arm-lock engaged to hold the tremolo lever in a non-neutral position.
Figure 20:
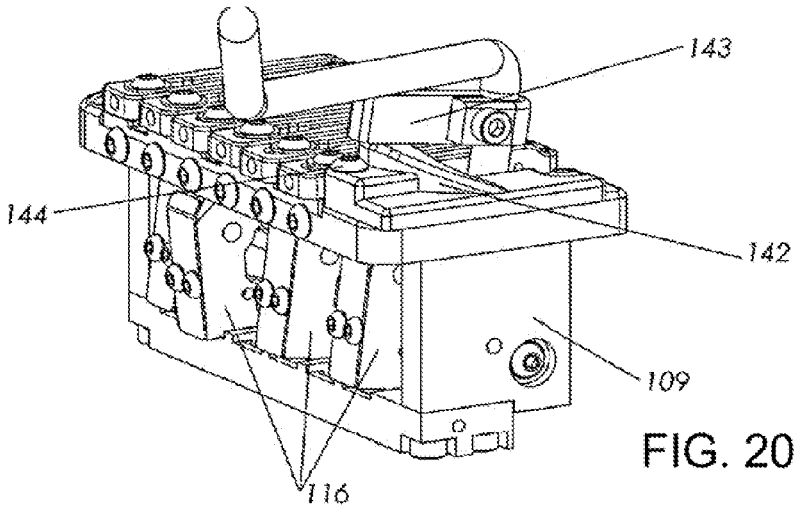
FIG. 20 is side perspective view of an exemplary bridge with the arm-lock engaged showing the various positions of the deflection arms.

Referring now to FIGS. 18-20, a tremolo lock 777 enables locking a tremolo arm into any suitable position. A tremolo lock comprises a ramp 142 and lever lock 143. The exemplary ramp 142 is rigidly attached to bridge plate 107 via screws 144 and can be removed when not used. The ramp comprises an incline plane that interfaces with the tremolo lever and holds the tremolo lever by friction therebetween. The exemplary lever lock 143 attaches to the tremolo lever 106 by tightening screw 145 and clamping it onto the tremolo lever 106. The lever lock 143 can be height adjusted and rotationally adjusted about the tremolo lever 106 to achieve a different amount of deflection of the tremolo lever 106 when in the locked position at the top of the lever ramp 142. FIG. 18 shows the position of the tremolo lever when lever lock 143 is not engaged with the lever ramp 142. In FIGS. 19-20, the tremolo lever 106 has been rotated such that the tremolo lever lock 143 is engaged at the top of the ramp 142 and is holding the tremolo lever 106 in a non-neutral position. This allows for the user to quickly and easily shift into an alternate tuning, if desired. In order to do this, the amount of pitch change must be pre-determined by adjusting the tremolo lock position and base roller 115 position via screw 114. FIG. 20 illustrates the tremolo lock configured so that deflection arm 116 is locked and increasing the pitch of some strings and decreasing the pitch of other strings. Some of the deflection arms 116 are not present, in which case the pitch of the string will not change when in the locked position.

Figure 21:
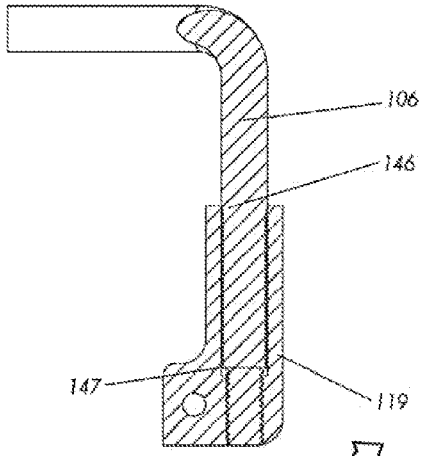
FIG. 21 is a section view taken across line BB-BB of FIG. 2 detailing the connection of the tremolo lever to the tremolo lever connector and actuating rod.

FIG. 21 is a section view taken across line BB of FIG. 2. This illustration shows a method of attaching a tremolo lever 106 to the connector portion 119 with minimal slop. The end of the tremolo lever 106 is threaded into a threaded hole in the connector portion 119. As tremolo lever 106 is threaded into the connector portion 119, the tapered section 146 of the tremolo lever 106 is drawn tighter into the tapered hole 147 connector portion 119, eliminating, or minimizing any play between the tremolo lever 106 and the connector portion 119.

Figure 22A:
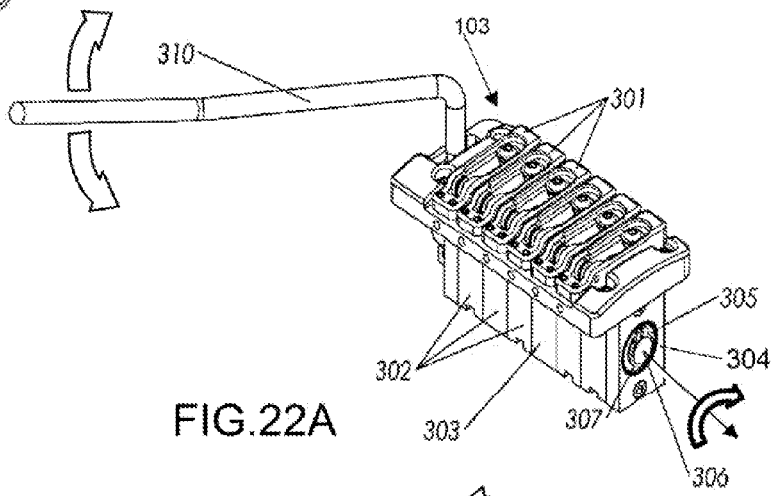
FIGS. 22A-22B show perspective views of an exemplary bridge.
Figure 22B:
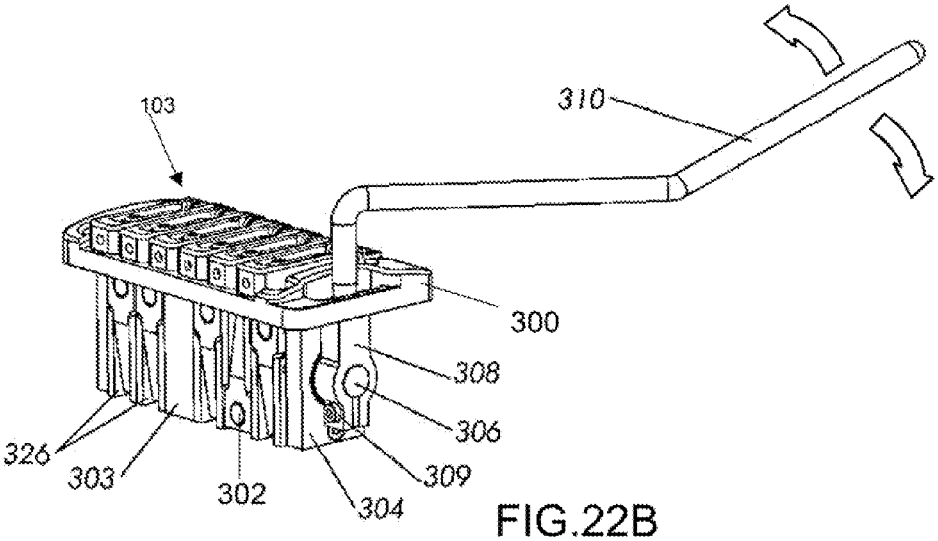

An alternate embodiment of the tremolo bridge mechanism 103 is described in FIGS. 22A-I. FIGS. 22A and 22B are perspective drawings of the alternate embodiment. The exemplary embodiment comprises a tremolo bridge 103 having a bridge plate 300 that is configured to be rigidly attached to the body of a stringed musical instrument, such that the bridge does not move with respect to, or relative to the instrument body. The bridge comprises a bridge plate 300 to which bridge saddle mechanisms 301 are adjustably attached on the top and to which spring elements 302 or bypass blocks 303 are attached at the bottom. At each end of the spring elements is a pillow block 304 which is rigidly attached to the spring elements 302 and the bridge plate 300. In each pillow block 304, is a ball bearing 305 through which the actuating rod 306 passes. The axis of the actuating rod 306 is perpendicular to the strings. One end of the actuating rod 306 has a retaining ring 307 attached, preventing it from moving in one direction. The tremolo lever connector 308 is rigidly attached to the actuating rod 306 by tightening screw 309. Tremolo lever 310 passes through the tremolo lever connector 308 and is attached to the actuating rod, such as by threading into the actuating rod. The tremolo lever is therefore coupled with the actuating rod 306 such that rotation of the tremolo lever about the rotational axis of the actuating rod directly rotates the actuating rod 306. The tremolo lever can swivel, as indicated by the arrows in a direction that is substantially parallel with the bridge plate 300, or an instrument body that it is attached to. The actuating rod has a rotational axis as indicated by the line extending from the retaining ring in FIG. 22A and the bold arced arrow indicating the rotation direction around the rotational axis.

Figure 22C:
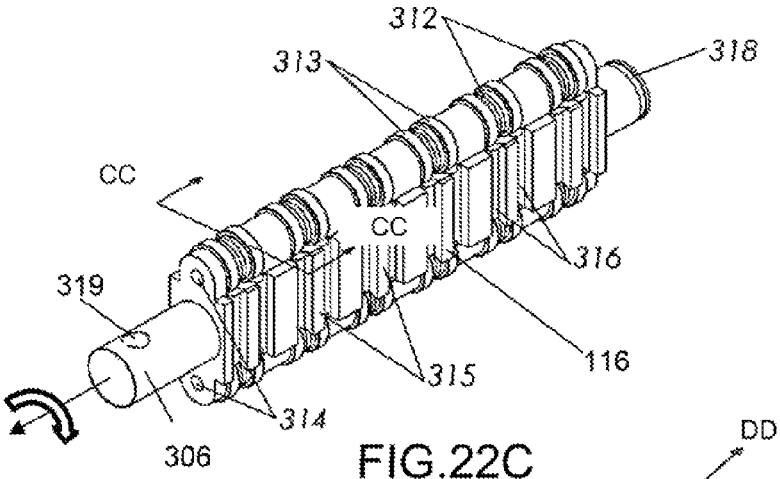
FIG. 22C shows a perspective view of an exemplary actuating rod of the exemplary bridge shown in FIGS. 22A-22B.
Figure 22D:
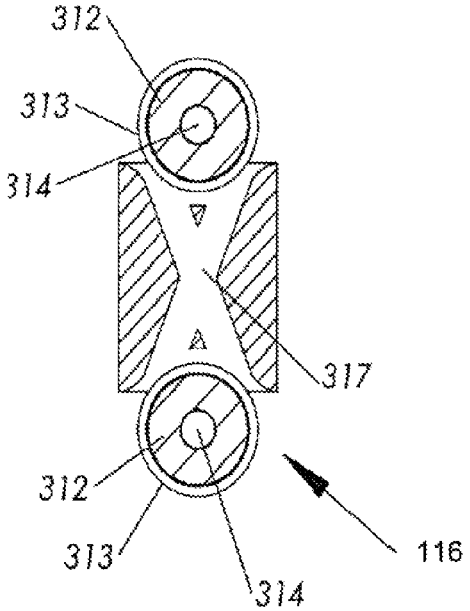
FIG. 22D shows a section view along line CC of FIG. 22C.

Each spring element 302 can be oriented in one of two ways as shown in FIG. 22B to bridge plate 300. Each spring element 302 has a spring lever 311 that interacts with actuating rod 306. Depending upon the orientation of spring element 302, the string will pass through one of two routes in the actuating rod 306 (see FIG. 22D). The route that the string takes through the actuating rod 306 will determine if the string pitch increases or decreases when the tremolo lever 310 is actuated towards the body, and vice versa. FIG. 22C and FIG. 22D show details of an actuating rod 306. Again, in FIG. 22C, the rotational axis of the actuating rod is shown as a line extending from the end of the actuating rod. For each string, two rollers 313, 313' interact with the spring element lever 311. Each string 104 passes over rollers 312, 312' located between rollers 313. Rollers 312 and 313 are pinned to the actuating rod 306 via metal pins 314 that are rigidly attached and allow rollers 312 and 313 to freely rotate. Roller 312 has a groove in the center of the periphery to keep the string 104 in the correct position. Ridges 315 are to facilitate easy string loading and adjacent grooves 316 are to provide clearance for the spring lever 311. FIG. 22D is a section view taken across line CC in FIG. 22C. For each string 104 there are two holes 317 extending through the actuating rod 306 for which the string 104 can pass. At one end of the actuating rod 306, a groove 318 is cut to accommodate the retaining ring 307. At the other end is a threaded hole 319 that the tremolo lever 310 threads into. The tremolo connecting arm 308 connects around the threaded hole 310.

Figure 22E:
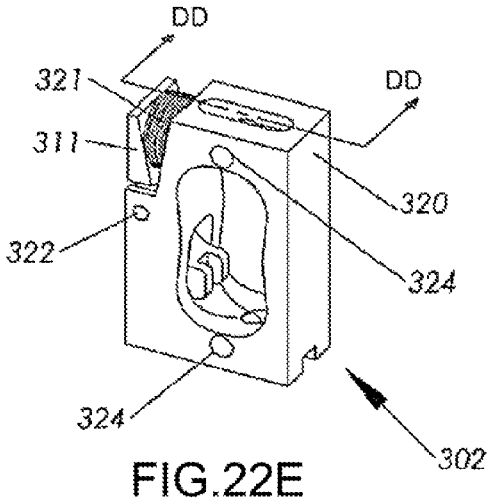
FIG. 22E shows a perspective view of a portion of an exemplary pitch adjustment feature shown in FIG. 22C.
Figure 22F:
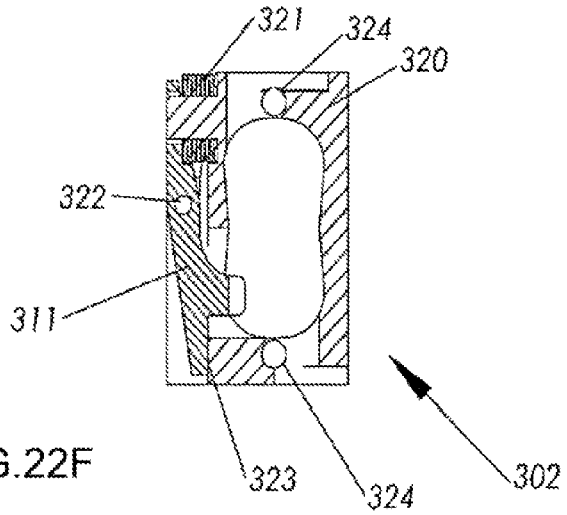
FIG. 22F shows a section view along line DD of FIG. 22E.

FIGS. 22E through 22F show details of a spring element 302. Each spring element consists of a spring block 320, spring lever 311, and spring array 321. An exemplary spring array 321 comprises a series of stacked Belleville washers. The spring lever 311 is connected to the spring block by a connecting pin 322 which allows the spring lever 311 to freely rotate. FIG. 22F is a section taken across lines DD of FIG. 22E. The motion of the spring lever 311 is limited in one direction by spring block 320 and in the other direction by spring array 321. An interface 323 between the spring lever 311 and spring block 320 is the neutral position of the spring element mechanism, or bridge mechanism. The force exerted by the spring array 321 is greater than the force exerted by the actuating rod 306, due to the string tension, which keeps the mechanism in the neutral position until the tremolo lever 310 is actuated. Holes 324 in the spring block are used to clamp the spring elements 302 together and to the pillow blocks 304, which may then be attached to the bridge plate 300.

Figure 22G:
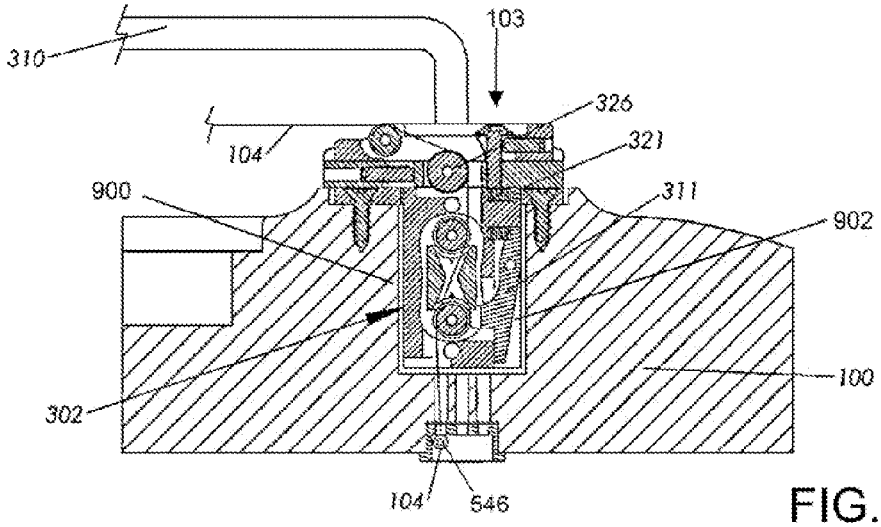
FIGS. 22G-22I are section views of the exemplary bridge shown in FIG. 22A configured in a stringed instrument.
Figure 22H:
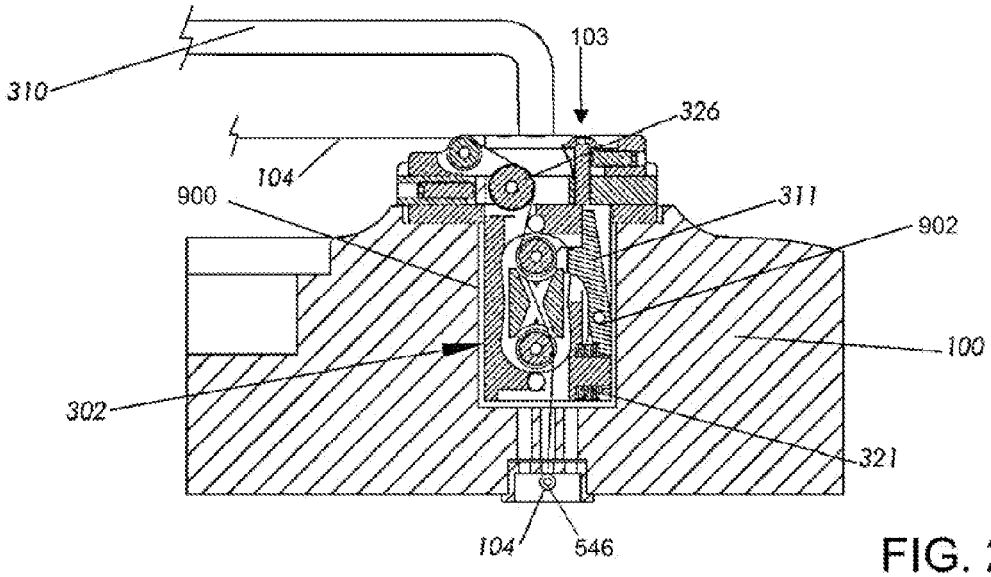
Figure 22I:
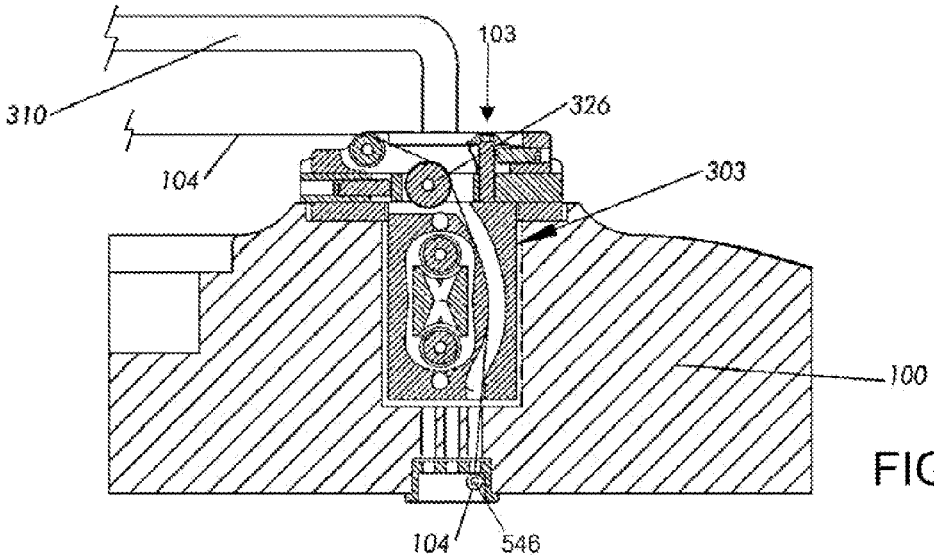

FIGS. 22G through 22I are section views taken across a section parallel to the strings shown. FIG. 22G shows a spring element 302 oriented with the spring element 302 configured in an up configuration, or proximal to the bridge plate, to produce a normal tremolo effect, wherein rotation of the tremolo lever 310 about the rotational axis of the actuating rod and towards the guitar body decreases the string pitch or reduces tension in the string. FIG. 22H shows a spring element 302 oriented with the spring element configured in a down configuration, or distal from the bridge plate, to produce a reversed tremolo effect, wherein rotation of the tremolo lever about the rotational axis of the actuating rod and towards the guitar body increases the string pitch, or increases tension on the string. The string 104 contacts rollers 312 and these rollers are rotated within the spring element 302 as a function of the tremolo lever motion. As shown in FIG. 22G, the string 104 extends over the top roller 312 on the base side 902 of the instrument and then over the second roller on the neck side 900 of the instrument. The base side is the side of the bridge mechanism that is closest to the base of the stringed instrument and the neck side is closest to the neck of the stringed instrument. Alternatively, as shown in FIG. 22H, the string 104 extends over the top roller 312 on the neck side 900 of the instrument and then over the second roller on the base side 902 of the instrument. As shown in FIG. 22I, the string passes over a bypass block 303 used to replace spring element 302 so that the string is not affected by actuating tremolo lever 310. In addition, the base roller 325 can be moved in a direction parallel to the strings to adjust the amount of pitch change for a given the deflection of tremolo lever 310.

Figure 23:
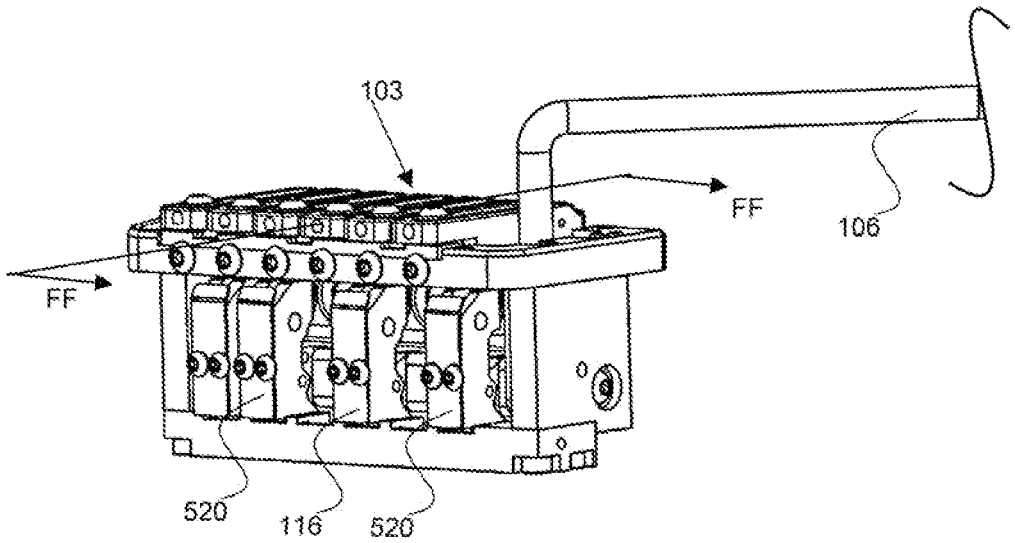
FIG. 23 is a perspective view of an exemplary bridge having two pitch adjustment features detached from the bridge.

As shown in FIG. 23, an exemplary bridge 103 has a portion of two pitch adjustment features 520 detached from the bridge. The deflection arms 116 have been detached from the bridge assembly to eliminate pitch adjustment from the movement of the tremolo lever for those assemblies.

Figure 24:
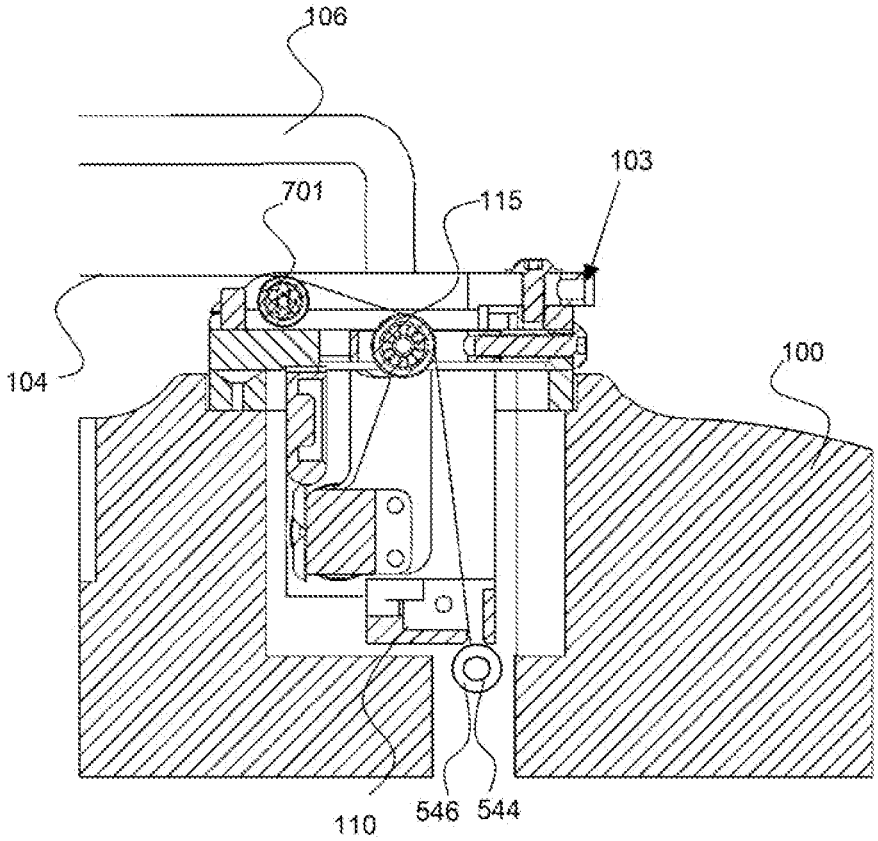
FIG. 24 is a section view of the bridge shown in FIG. 23 along line FF having a pitch adjustment feature detached.

As shown in FIG. 24, the string 104 extends through the bridge 103 without the deflection arm attached. The string still contacts the saddle roller 701, the base roller 115 and extends through the bottom bracket 110 and the ball-end 544 is retained by the bottom bracket such that is does not move with respect to the instrument 100. The body-end 544 of the string 104 is rigidly attached to the body 100 and the tension of the string will not be affected by movement of the tremolo lever 106 as it is not coupled with a deflection arm for this bridge assembly.

Figure 25:
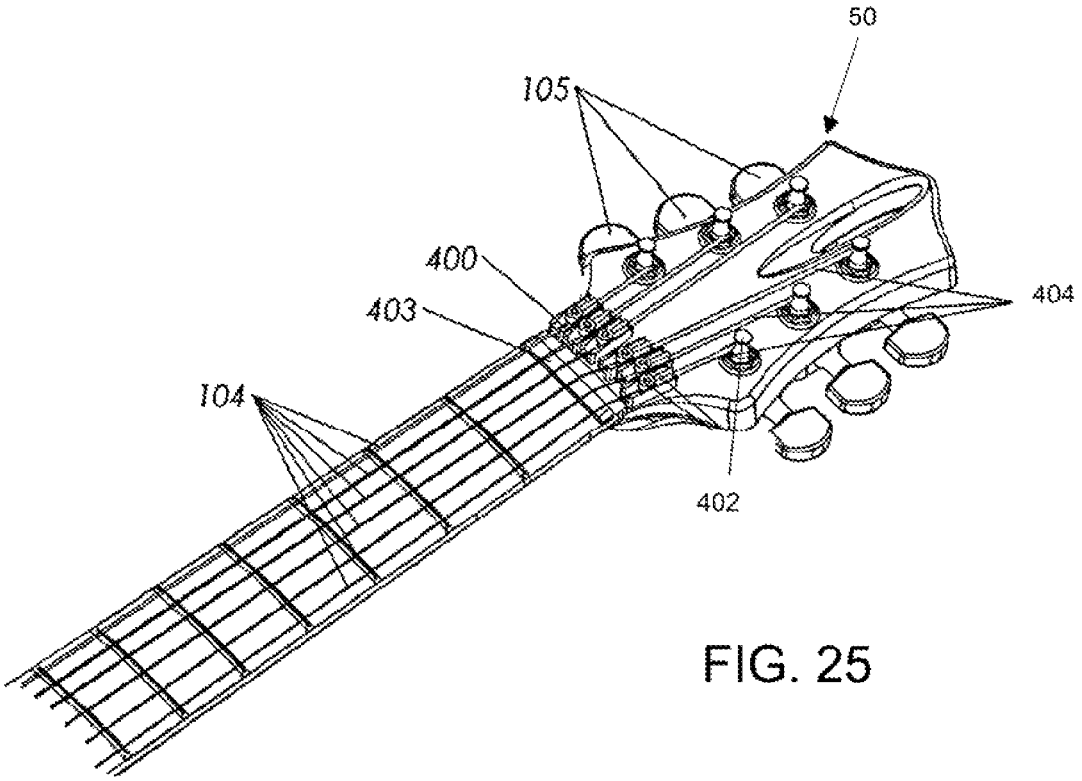
FIG. 25 is a perspective view of a neck and peghead end of a stringed instrument having an exemplary string tuner extension coupled to the neck end of an instrument string.
Figure 26:
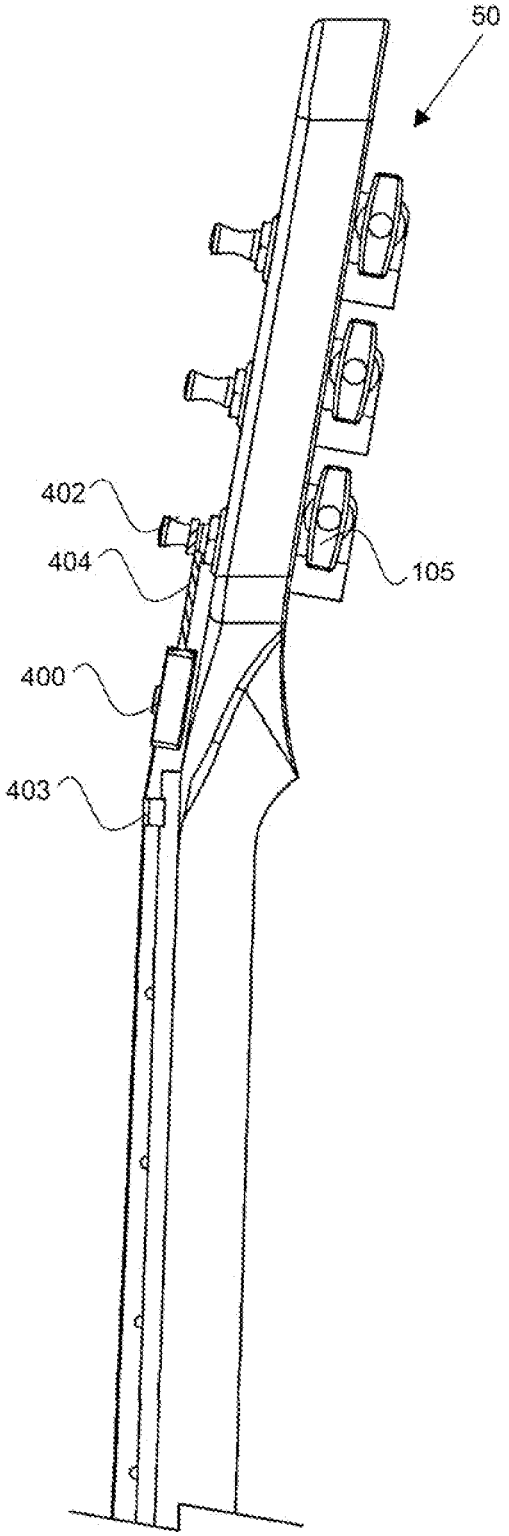
FIG. 26 is a side view of a neck and peghead end of a stringed instrument having an exemplary string tuner extension coupled to the neck end of an instrument string.

As shown in FIGS. 25 and 26, an exemplary stringed musical instrument comprises a string tuner extension comprising a string lock 400 and tuner extension 404. The string locks 400 are discrete attachment devices that securely affix to individual instrument strings 104. The string lock may comprise a slot for extending the instrument string therethrough and a screw or other fastener to secure the instrument string to the string lock. The instrument string may be wound around the string lock or a post configured thereon in other embodiments. The string lock is free floating and has a tuner extension, such as a string, that extends from the string lock to the string attachment posts 402. The string attachment posts are coupled with the tuning mechanisms 105, or tuners, to enable changing the tension of the string attached thereto. The tuner extensions 404 are configured to have minimal elongation under the tension normally associated with musical instrument strings. This configuration enables tuning of the individual strings and reduced movement of the instrument strings over the nut 403. Movement of instrument strings over the nut is not desired as it introduces wear and premature string breaks. The string lock is configured just above the nut, or between the nut and the tuner, and movement of the string over the nut, as a function of tremolo action, will be minimized, thereby improving string life and pitch stability.

Definitions

The term bridge, as used herein, is used for brevity in place of a tremolo bridge mechanism throughout the specification.

Stringed musical instruments, as used herein, refers to the broad class of stringed instruments having a body, neck, bridge, and a plurality of strings and includes but is not limited to, guitars, bass guitars, both acoustic and electric, banjoes, violins, violas, double bass and the like.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A stringed musical instrument comprising:

a) a body comprising:
- a front surface;
- a back surface;
- a bridge cavity configured between the front and back surfaces;
- a base end; and
- a neck end;

b) a neck that is attached to the body and has an extended end;

c) a peghead configured at the extended end of the neck;

d) a plurality of strings each having a neck-end and a body-end;

e) a bridge attached to the body and comprising:
- a bridge plate rigidly attached to the front surface of the body;
  - whereby the bridge plate does not move with respect to the body;
- a plurality of pitch adjustment features each comprising:
  - a dynamic string contact;
  - a deflection arm coupled with the dynamic string contact;
  - a spring coupled to and configured to exert a force against the deflection arm;

f) a tremolo lever;
- wherein the tremolo lever is coupled with each pitch adjustment feature to change the pitch of one of said plurality of strings when the tremolo lever is moved; and
- wherein at least a portion of the plurality of strings are attached to the peghead, extend along said neck, over said bridge, over said dynamic string contact and said body-end is fixedly coupled to the stringed musical instrument and does not move with respect to the body.

2. The stringed musical instrument of claim 1, further comprising:
- an actuator rod;
- wherein the each deflection arm is coupled with the actuator rod and
- whereby movement of the actuating rod moves the deflection arm and the string contact to change the pitch of one of said plurality of strings;

wherein the tremolo lever has an attached end that is coupled with said actuating rod and an extended end that is rotatable about a rotational axis of the actuator rod rotation;
- wherein rotation of said tremolo lever adjusts the pitch of one or more of the plurality of strings.

3. The stringed musical instrument of claim 2, wherein each of the pitch adjustment features comprise a linkage that extends between and couples each of the actuator rod to the deflection arm.

4. The stringed musical instrument of claim 3, wherein the actuator rod comprises a first pin location and a second pin location for attachment of the linkage to the actuator rod by a pin, wherein when the linkage is attached in the first pin location, movement of the tremolo lever in a first direction increases the pitch of a string coupled to the pitch adjustment feature and when the linkage is attached in the second pin location, movement of the tremolo lever in a first direction decreases the pitch of said string.

5. The stringed musical instrument of claim 4, wherein the linkage is attached to the deflection arm by a pin, whereby the linkage can rotate about said pin.

6. The stringed musical instrument of claim 1, wherein at least portion of one of the plurality of pitch adjustment features is detachably attachable to the bridge.

7. The stringed musical instrument of claim 1, wherein the body-ends of the plurality of strings are retained in the back surface of the body.

8. The stringed musical instrument of claim 1, wherein the body-ends of the plurality of strings are retained by the bridge.

9. The stringed musical instrument of claim 1, further comprising a tremolo lock comprising:

a) a ramp;

b) a lever lock that extends from the tremolo lever and is configured to interface with the ramp such that swiveling the tremolo lever with respect to the ramp retains the tremolo lever in a fixed non-neutral rotational position.

10. The stringed musical instrument of claim 9, wherein the ramp is detachably attached to the bridge and the tremolo lock is detachably attachable to the tremolo lever.

11. The stringed musical instrument of claim 9, wherein the tremolo lock is adjustable in position along a length of the tremolo lever and adjustable in rotational position about said tremolo lever.

12. The stringed musical instrument of claim 1, comprising a plurality of adjustable rollers, wherein each of said adjustable rollers is configured to be adjusted in position by a user to change the pitch of a string extending over said adjustable roller.

13. The stringed musical instrument of claim 12, wherein each of the adjustable rollers is configured to change position substantially parallel with a plane of the bridge plate and substantially parallel to a direction of the plurality of strings.

14. A tremolo bridge for a stringed musical instrument comprising:

a) a bridge plate rigidly attached to a front surface of an instrument body;
- wherein the bridge plate does not move with respect to the instrument body;

b) a plurality of pitch adjustment features each comprising:

a deflection arm coupled with the actuating rod and comprising a dynamic string contact;

a spring coupled to and configured to exert a force against the deflection arm to configure the deflection arm in a neutral position;

c) a tremolo lever and an actuating rod having a rotational axis;

wherein the tremolo lever is coupled with the actuating rod and configured to move the actuating rod about the rotational axis;

whereby rotation of the tremolo lever about the rotational axis of the actuating rod, moves the deflection arm out of a neutral position and changes the pitch of a string extending over the dynamic string contact; and wherein said string has a base end that does not move with respect to the tremolo bridge mechanism.

15. The tremolo bridge for a stringed musical instrument of claim 14, wherein each of the plurality of pitch adjustment features comprises a linkage that extends between and couples the actuator rod to the deflection arm.

16. The stringed musical instrument of claim 15, wherein each of the plurality of pitch adjustment features are reversible;

wherein the actuator rod comprises a first pin location and a second pin location for attachment of the linkage to the actuator rod by a pin, wherein when the linkage is attached in the first pin location, movement of the tremolo lever in a first direction increases the pitch of a string coupled to the pitch adjustment feature; and wherein when the linkage is attached in the second pin location, movement of the tremolo lever in a first direction decreases the pitch of said string;

thereby providing a reversible pitch adjustment feature.

17. The stringed musical instrument of claim 15, wherein the linkage is attached to the deflection arm by a pin, whereby the linkage can rotate about said pin.

18. The tremolo bridge for a stringed musical instrument of claim 14, wherein each of the plurality of pitch adjustment features is reversible and comprises:

a) a reversible spring element comprising:

a spring array configured on an end of the reversible spring element and coupled with a spring lever;

wherein the deflection arm comprises:

a first string contact roller configured proximal to the bridge plate; and a second string contact roller configured distal the bridge plate;

wherein the deflection arm is directly coupled to the actuator rod; whereby rotation of the actuator rod about a rotational axis directly rotates the deflection arm;

wherein the spring element is reversible; whereby with the spring array in an up configuration and the string extending around the first contact roller on a base-side and around the second contact roller on a neck-side, rotation of the tremolo lever about the rotational axis of the actuating rod and towards the instrument body reduces a pitch of said string; and whereby with the spring array in an down configuration and the string extending around the first contact roller on a neck-end side and around the second contact roller on a base-side, rotation of the tremolo lever about the rotational axis of the actuating rod and towards the instrument body increases a pitch of said string;

thereby providing a reversible pitch adjustment feature.

* * * * *